US005518870A

United States Patent [19]

Sakakibara

[11] Patent Number: 5,518,870

[45] Date of Patent: May 21, 1996

[54] SILVER HALIDE COLOR PHOTOGRAPHIC MATERIAL

[75] Inventor: Yoshio Sakakibara, Kanagawa, Japan

[73] Assignee: Fuji Photo Film Co., Ltd., Kanagawa, Japan

[21] Appl. No.: 451,036

[22] Filed: May 25, 1995

Related U.S. Application Data

[63] Continuation of Ser. No. 629,753, Dec. 18, 1990, abandoned.

[30] Foreign Application Priority Data

Dec. 18, 1989 [JP] Japan ..... 1-325829

[51] Int. Cl.[6] ..... G03C 7/32

[52] U.S. Cl. ..... 430/505; 430/546; 430/552; 430/553; 430/557; 430/558

[58] Field of Search ..... 430/505, 546, 430/557, 558, 552, 553

[56] References Cited

U.S. PATENT DOCUMENTS

| | | | |
|---|---|---|---|
| 4,622,287 | 11/1986 | Umemoto et al. | 430/505 |
| 4,898,812 | 2/1990 | Aoki et al. | 430/546 |
| 4,910,127 | 3/1990 | Sakaki et al. | 430/546 |
| 4,912,026 | 3/1990 | Miyoshi et al. | 430/546 |
| 5,019,490 | 5/1991 | Kobayashi et al. | 430/503 |
| 5,055,386 | 10/1991 | Hirano et al. | 430/546 |

OTHER PUBLICATIONS

Partial translation of pp. 10 and 11 of Japanese Patent Application 01–92745 filed Apr. 12, 1989.

*Primary Examiner*—Janet C. Baxter

*Attorney, Agent, or Firm*—Sughrue, Mion, Zinn, Macpeak & Seas

[57] ABSTRACT

A silver halide color photographic material comprising a support having thereon a yellow coupler-containing silver halide emulsion layer, a magenta coupler-containing silver halide emulsion layer and a cyan coupler-containing silver halide emulsion layer, wherein each silver halide emulsion layer contains silver halide grains having a silver chloride content of not lower than 90 mol %, a yellow coupler in said yellow coupler-containing silver halide emulsion layer is coated in an amount of at least 1.1 mmol/m$^2$, oil/coupler ratio by weight in the yellow coupler-containing silver halide emulsion layer is 0.32 or less and the magenta coupler-containing layer contains at least one magenta coupler represented by the following general formula (I):

(I)

wherein $R^1$ and $R^2$ represent each a hydrogen atom or a substituent group; X represents a hydrogen atom or group which is eliminated by a coupling reaction with an oxidation product of an aromatic primary amine developing agent; Z represents a nitrogen atom or a carbon atom and when Z represents carbon atom, a substituent group may be bonded to said carbon atom; and a dimer or a higher polymer may be formed through $R^1$, $R^2$ or X, or when Z is carbon atom, a dimer or a higher polymer may be formed through said carbon atom.

13 Claims, No Drawings

SILVER HALIDE COLOR PHOTOGRAPHIC MATERIAL

This is a continuation of application Ser. No. 07/629,753, filed Dec. 18, 1990, now abandoned.

FIELD OF THE INVENTION

The present invention relates to a silver halide color photographic material having improved color reproducibility during storage. More particularly, it relates to a silver halide color photographic material which gives a high-quality color image even when using rapid processing and prevents the hue of a yellow image from being deteriorated even when the resulting color image is stored under high temperature and high humidity conditions.

BACKGROUND OF THE INVENTION

Generally, silver halide color photographic materials have silver halide emulsion layers which are sensitive to the three primary colors of blue, green and red and form yellow color, magenta color and cyan color, respectively. A dye image is reproduced by subtractive color photography. Accordingly, dye images which are reproduced depend greatly on the color sensitivity characteristics of each layer and the spectral absorption characteristics of color formation. Generally, these characteristics are not always optimized because of the restriction on color formability of the compounds used. Particularly, the hue of the developed color of magenta couplers is important for color reproducibility.

Many improvements in magenta couplers have been made. Of these, pyrazoloazole magenta couplers are excellent in spectral absorption characteristics of the developed color hue in particular. In order to improve the developed color hue of 5-pyrazolone magenta couplers, there have been developed anilino magenta couplers (see JP-A-49-74027 (the term "JP-A" as used herein means an "unexamined published Japanese patent application") corresponding to U.S. Pat. No. 3,907,571 and JP-A-49-111631 corresponding to U.S. Pat. No. 3,935,015) which are superior in spectral absorption characteristics to ureido and acylamino couplers.

Further, there have been developed pyrazoloazole magenta couplers (see, U.S. Pat. Nos. 3,725,067, 3,369,897, 4,500,630 and 4,540,654, JP-A-60-33552, JP-A-60-43659) which exhibit unnecessary secondary absorption. Couplers of these types are advantageous in that unnecessary absorption in the regions of blue light and red light is small in comparison with dye images obtained from 5-pyrazolone magenta couplers. Accordingly, these couplers have improved color reproducibility. Further, these couplers have advantages in that the couplers are stable in the presence of light, heat and humidity and are difficult to decompose. Hence the resulting images are not yellowed. Among the pyrazoloazole magenta couplers, pyrazolo[1,5-b][1,2,4]triazole derivatives are excellent in color formation and fastness to light.

Rapid processing has been increasingly important in the photographic market in recent years.

Silver halide mainly composed of silver bromide has been conventionally used. However, silver halide composed mainly of silver bromide is disadvantageous in rapid processing, because bromide ion restrains development. Accordingly, it is preferred that silver halide composed mainly of silver chloride is used for rapid processing. Thus, a high silver chloride emulsion having a high silver chloride content is advantageous in rapid processing.

A problem has been observed in photographic materials containing a high silver chloride emulsion in combination with pyrazoloazole magenta couplers such as pyrazolo[1,5-b][1,2,4]triazole derivatives; a magenta color is formed during storage under moist heat conditions and there is a deterioration in the yellow hue of the image. Thus, there is a great demand for photographic materials which are improved in yellow color reproducibility (retention) during storage.

SUMMARY OF THE INVENTION

An object of the present invention is to provide a silver halide color photographic material which does not cause a deterioration in yellow hue of the image during storage under moist heat conditions.

Another object of the present invention is to provide a silver halide color photographic material which allows magenta color to be well reproduced, has good color formability and fastness to light, and can be rapidly processed.

These and other objects of the present invention have been accomplished by providing a silver halide color photographic material comprising a support having thereon a yellow coupler-containing silver halide emulsion layer, a magenta coupler-containing silver halide emulsion layer and a cyan coupler-containing silver halide emulsion layer, wherein each silver halide emulsion layer contains silver halide grains having a silver chloride content of not lower than 90 mol %, a yellow coupler in the yellow coupler-containing silver halide emulsion layer is coated in an amount of at least 1.1 mmol/$m^2$, oil/coupler ratio by weight in the yellow coupler-containing silver halide emulsion layer is 0.32 or less, and the magenta coupler-containing silver halide emulsion layer contains at least one magenta coupler represented by the following general formula (I):

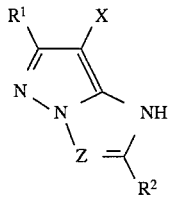

(I)

wherein $R^1$ and $R^2$ each represent a hydrogen atom or a substituent group; X represents a hydrogen atom or a group which is eliminated by a coupling reaction with an oxidation product of an aromatic primary amine developing agent; and Z represents a nitrogen atom or a carbon atom and when Z is a carbon atom, a substituent group may be bonded to the carbon atom.

Examples of $R^1$, $R^2$ and X are those described below in the definition of the following general formulae (II) and (III).

A dimer or higher polymer may be formed through $R^1$, $R^2$ or X. When Z is a carbon atom, a dimer or a higher polymer may be formed through this carbon atom.

The term "a dimer or a higher polymer" as used above means those compounds having two or more groups represented by the general formula (1) per molecule, including bis-compounds and polymer couplers. The polymer couplers may be homopolymers composed of only one monomer, preferably a monomer having an ethylenically unsaturated group (hereinafter referred to as vinyl monomer), having a moiety represented by the general formula (I) or copolymers thereof with a non-color forming ethylenic monomer which does not couple with an oxidation product of an aromatic primary amine developing agent.

Thus, the present inventors have surprisingly found that when pyrazoloazole magenta couplers such as pyrazolo[1,5-b][1,2,4]triazole derivative magenta couplers are used, the formation of magenta color in the yellow image portion of the image during storage under moist heat conditions can be remarkably inhibited by coating a yellow coupler in an amount of at least 1.1 mmol/$m^2$, and controlling oil/coupler ratio by weight in the yellow coupler-containing silver halide emulsion layer is within a range of 0.32 or less.

DETAILED DESCRIPTION OF THE INVENTION

The compounds represented by the general formula (I) are illustrated in more detail below.

The compounds represented by the general formula (I) are 1H-imidazo[1,2-b]pyrazole compounds and 1H-pyrazolo[1,5-b][1,2,4]triazole compounds. These compounds can be represented by the following general formulae (II) and (III), respectively. The compounds represented by the following general formula (III) are particularly preferred.

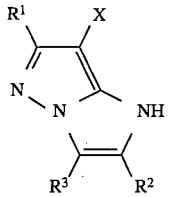

(II)

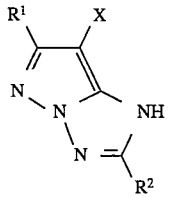

(III)

In general formulae (II) and (III), $R^1$, $R^2$ and $R^3$ are independently a hydrogen atom, a halogen atom, an alkyl group, an aryl group, a heterocyclic group, cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X is a hydrogen atom, a halogen atom, a carboxyl group or a group which is bonded to a carbon atom at the coupling position through an oxygen atom, a nitrogen atom or a sulfur atom and is eliminated by the coupling reaction.

$R^1$, $R^2$, $R^3$ or X may be a bivalent group to form a bis-compound. When a group represented by formula (II) or (III) is a moiety of a vinyl monomer, $R^1$, $R^2$ or $R^3$ is a single bond or a bonding group and the group represented by formula (II) or (III) is bonded to an ethylenically unsaturated group through $R^1$, $R^2$ or $R^3$.

More specifically, $R^1$, $R^2$ and $R^3$ are each a hydrogen atom, a halogen atom (e.g., chlorine, bromine), an alkyl group (e.g., methyl, propyl, t-butyl, trifluoromethyl, tridecyl, 3-(2,4-di-t-amylphenoxy)propyl, 2-dodecyloxyethyl, 3-phenoxypropyl, 2-hexylsulfonylethyl, cyclopentyl, benzyl), an aryl group (e.g., phenyl, 4-t-butylphenyl, 2,4-di-t-amylphenyl, 4 -tetradecaneamidophenyl), a heterocyclic group (e.g., 2 -furyl, 2-thienyl, 2-pyridmidinyl, 2-benzothiazolyl), cyano group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy), a heterocyclic oxy group (e.g., 2-benzimidazolyloxy), an acyloxy group (e.g., acetoxy, hexadecanoyloxy), a carbamoyloxy group (e.g., N-phenylcarbamoyloxy, N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecaneamido, α-(2,4-di-t-amylphenoxy)butylamido, γ-(3-t-butyl-4-hydroxyphenoxy)butylamido, α-{4-(4-hydroxyphenylsulfonyl)phenoxy} decaneamido), an anilino group (e.g., phenylamino, 2-chloroanilino, 2-chloro-5-tetradecaneamidoanilino, 2 -chloro-5-dodecyloxycarbonylanilino, N-acetylanilino, 2 -chloro-5-{α-(3-t-butyl-4-hydroxyphenoxy-)dodecaneamido}-anilino), a ureido group (e.g., phenylureido, methylureido, N,N-dibutylureido), imido group (e.g., succinimido, 3-benzylhydantoinyl, 4-(2-ethylhexanoylamino)phthalimido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3 -pentadecylphenylthio, 2-carboxyphenylthio, 4-tetradecaneamidophenylthio), a heterocyclic thio group (e.g., 2-benzothiazolylthio), an alkoxycarbonylamino group (e.g., methoxycarbonylamino, tetradecylcarbonylamino), an aryloxycarbonylamino group (e.g., phenoxycarbonylamino 2,4-di-t-butylphenoxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)propyl}carbamoyl), an acyl group (e.g., acetyl, (2,4-di-t-amylphenoxy)acetyl, benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), a sulfinyl group (e.g., octanesulfinyl, dodecylsulfinyl, phenylsulfinyl), an alkoxycarbonyl group (e.g., methoxycarbonyl, butyloxycarbonyl, dodecyloxycarbonyl, octadecyloxycarbonyl) or an aryloxycarbonyl group (e.g., phenoxycarbonyl, 3-pentadecylphenoxycarbonyl).

Preferably, X is a hydrogen atom, a halogen atom (e.g., chlorine, bromine, iodine), a carboxyl group or a group which is bonded through an oxygen atom (e.g., acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4 -methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzthiazolyloxy), a group which is bonded through a nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1 -benzylethoxy-3-hydantoinyl, 2-N-1,1-dioxo-3(2H)-oxo-1,2 -benzoisothiazolyl, 2-oxo-1,2-dihydro-1-pyridinyl, imidazolyl, pyrazolyl, 3,5-diethyl-1,2,4-triazole-1-yl, 5- or 6-bromobenztriazole-1-yl, 5-methyl-1,2,3,4-tetrazole-1-yl, benzimidazolyl, 3-benzyl-1-hydantoinyl, 1-benzyl-5-hexadecyloxy-3-hydantoinyl, 5-methyl-1-tetrazolyl, 4 -methoxyphenylazo, 4-pivaloylaminophenylazo, 4-hydroxy-4 -propanoylphenylazo) or a group which is bonded through a sulfur atom (e.g., phenylthio, 2-carboxyphenylthio, 2 -methoxy-5-t-octylphenylthio, 4-methanesulfonylphenylthio, 4-octanesulfonamidophenylthio, 2-butoxyphenylthio, 2-(2-hexanesulfonylethyl)-5-t-octylphenylthio, benzylthio, 2-cyanoethylthio, 1-ethoxycarbonyltridecylthio, 5 -phenyl-2,3,4,5-tetrazolylthio, 2-benzothiazolylthio, 2 -dodecylthio, 5-thiophenylthio, 2-phenyl-3-dodecyl-1,2,4 -triazolyl-5-thio).

When $R^1$, $R^2$, $R^3$ or X is a bivalent group that forms a bis-compound, examples of the bivalent group include a substituted or unsubstituted alkylene group (e.g., methylene, ethylene, 1,10-decylene, —$CH_2CH_2$—O—$CH_2CH_2$—); a substituted or unsubstituted phenylene group (e.g., 1,4-phenylene, 1,3-phenylene,

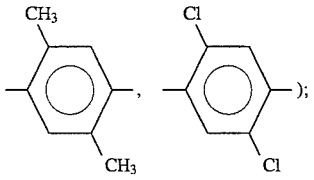

and a group of —NHCO-$R^4$—CONH— wherein $R^4$ is a substituted or unsubstituted alkylene or phenylene group).

When a group represented by the general formula (II) or (III) is a moiety of a vinyl monomer, the bonding group represented by $R^1$, $R^2$ or $R^3$ includes an alkylene group (e.g., a substituted or unsubstituted alkylene group such as methylene, ethylene, 1,10 -decylene, —$CH_2CH_2$—O—$CH_2CH_2$—), a phenylene group (e.g., a substituted or unsubstituted phenylene group such as 1,4-phenylene, 1,3-phenylene,

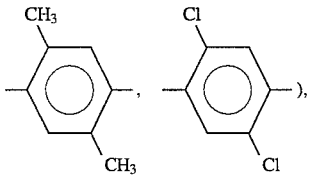

—NHCO—, —CONH—, —O—, —OCO—, an aralkylene group (e.g.,

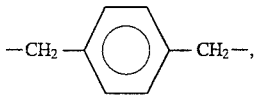

-continued

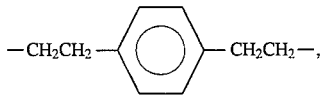

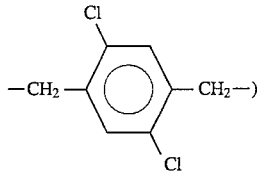

and groups composed of a combination thereof.

The ethylenically unsaturated group of the vinyl monomer may have substituent groups in addition to the moiety represented by formula (II) or (III). Preferred examples of the substituent groups include a hydrogen atom, chlorine atom and a lower alkyl group having 1 to 4 carbon atoms.

Examples of the non-color forming ethylenic monomer which does not couple with an oxidation product of an aromatic primary amine developing agent include acrylic acid, α-chloroacrylic acid, α-alkylacrylic acids (e.g., methacrylic acid) and amides and esters derived from these acrylic acid compounds (e.g., acrylamide, n-butylacrylamide, t-butylacrylamide, diacetone acrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate), methylene-bisacrylamide, vinyl esters (e.g., vinyl acetate, vinyl propionate, vinyl laurate), acrylonitrile, methacrylonitrile, aromatic vinyl compounds (e.g., styrene and derivatives thereof, vinyltoluene, divinylbenzene, vinylacetophenone, sulfostyrene), itaconic acid, citraconic acid, crotonic acid, vinylidene chloride, vinyl alkyl ethers (e.g., vinyl ethyl ether), maleic acid, maleic anhydride, maleic esters, N-vinyl-2-pyrrolidone, N-vinylpyridine and 2- or 4-vinylpyridine. These non-color forming ethylenically unsaturated monomers may be used either alone or in a combination of two or more of them.

The coupler compounds represented by the general formulae (II) and (III) and methods for preparing them are described in the literature. For example, the compounds of formula (II) are described in JP-A-59-162548. The compounds of formula (III) are described in JP-A-59-171956, JP-A-60-172982, JP-A-60-190779, JP-A-60-197688 and JP-A-60-215687.

Examples of the couplers represented by general formula (II) or (III) include, but are not limited to, the following compounds.

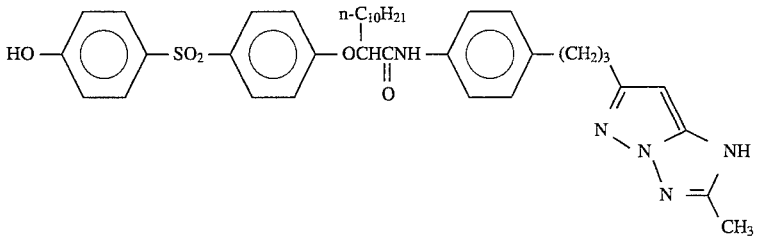

(M-1)

-continued
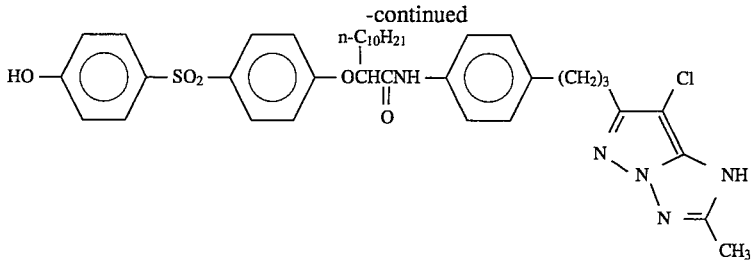
(M-2)
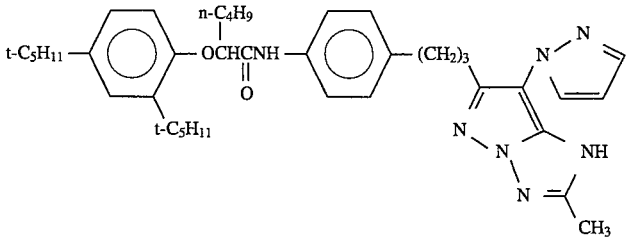
(M-3)
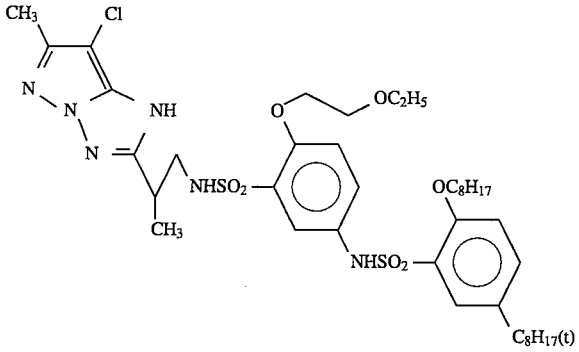
(M-4)
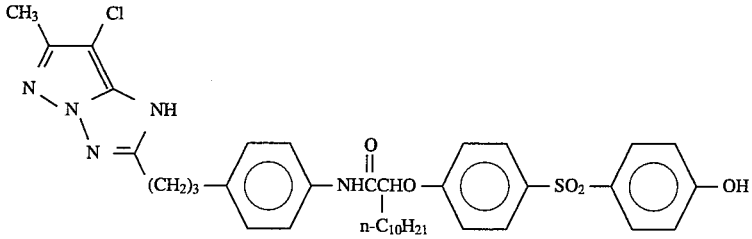
(M-5)
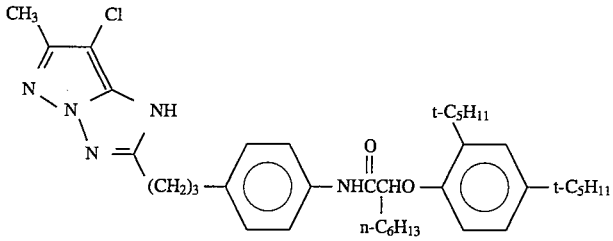
(M-6)
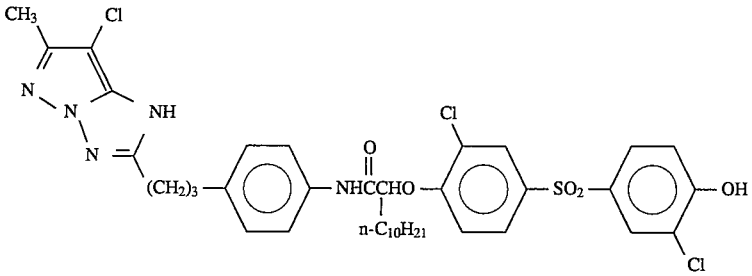
(M-7)

-continued
(M-8)
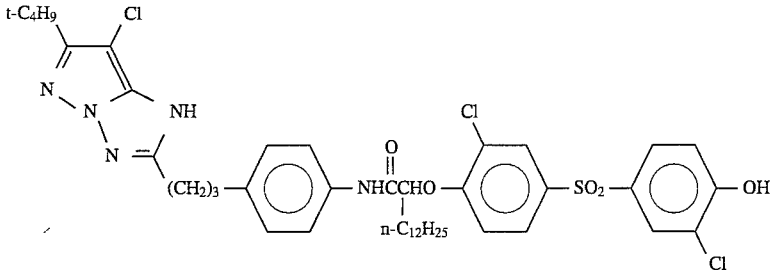
(M-9)
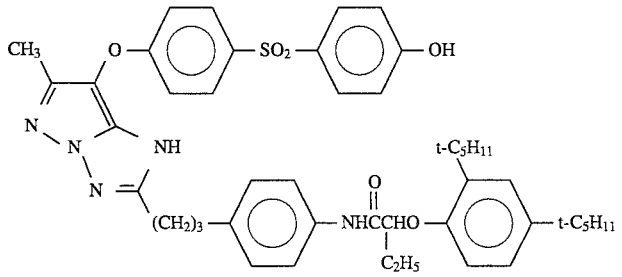
(M-10)
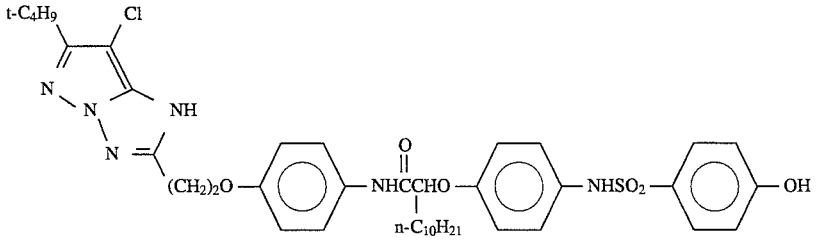
(M-11)
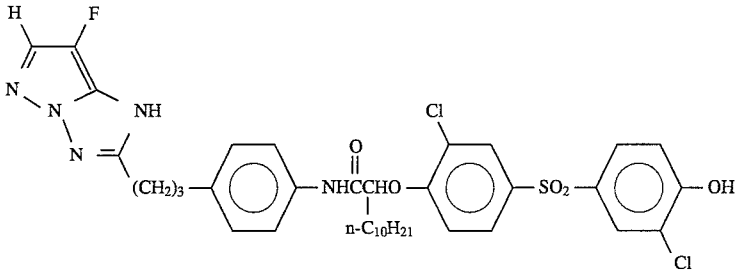
(M-12)
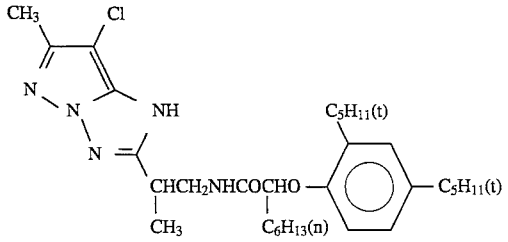
(M-13)
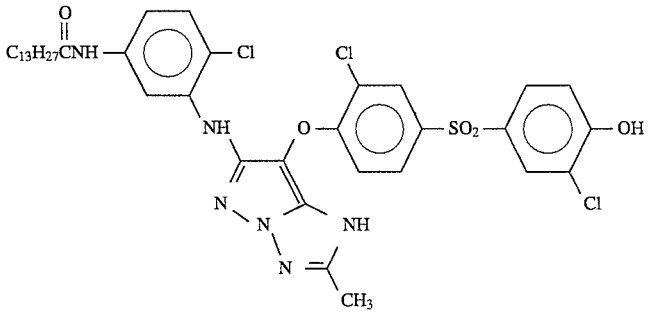

-continued
(M-14)
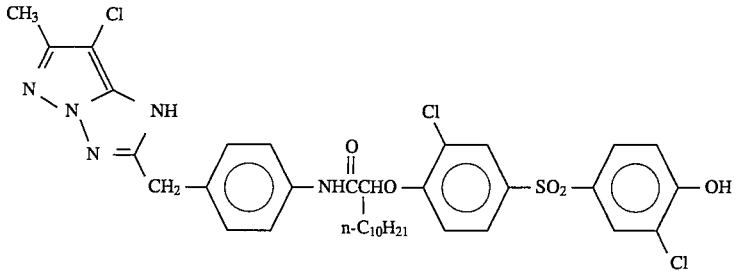
(M-15)
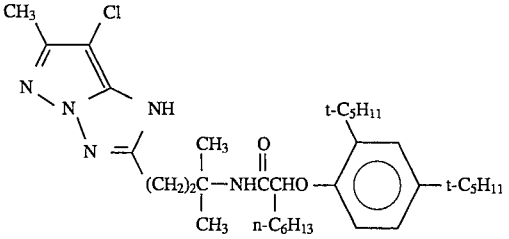
(M-16)
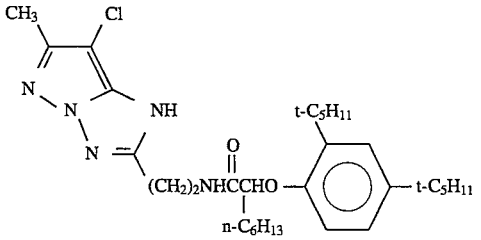
(M-17)
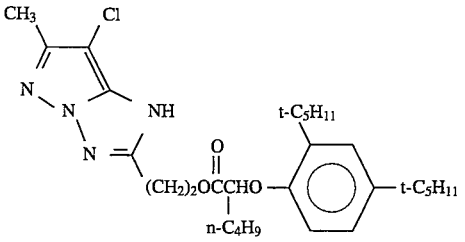
(M-18)
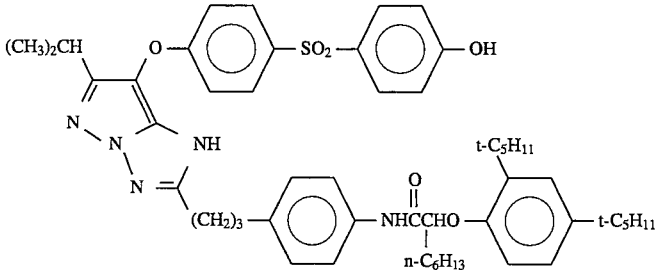
(M-19)
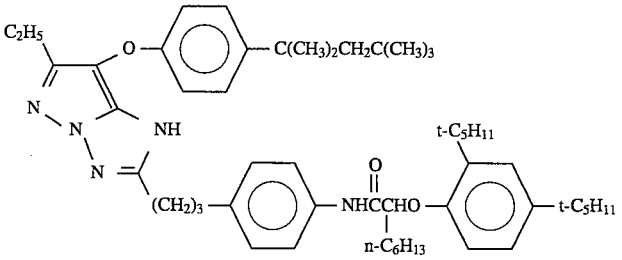
(M-20)
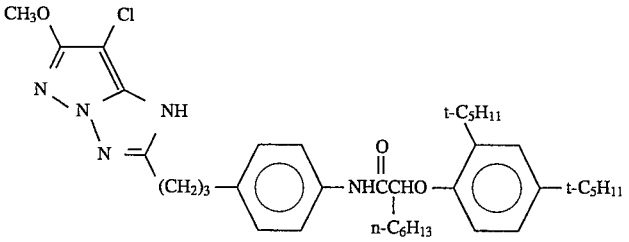

-continued
(M-21)
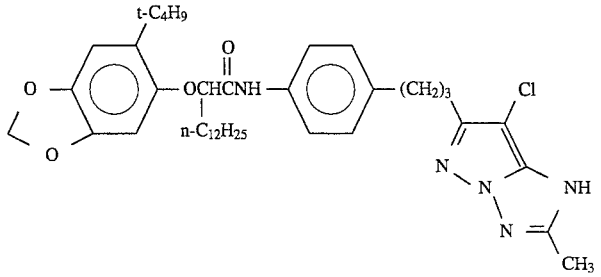
(M-22)
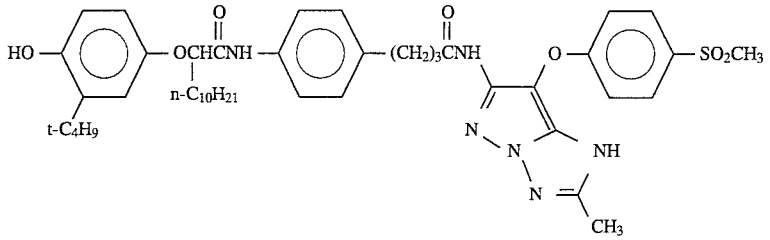
(M-23)
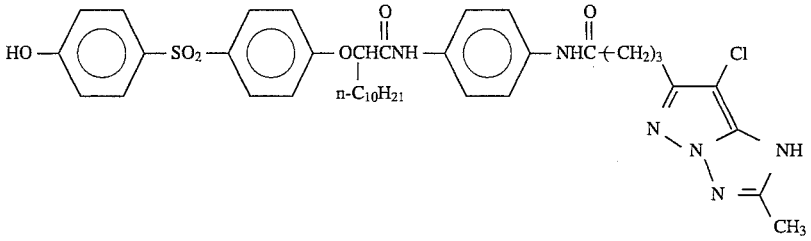
(M-24)
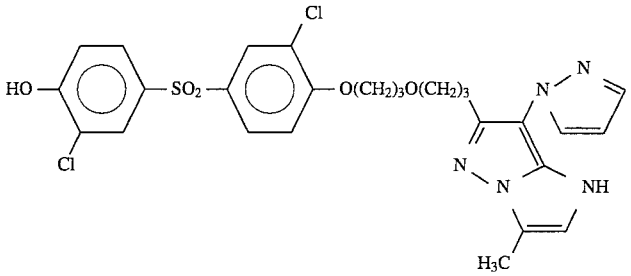
(M-25)
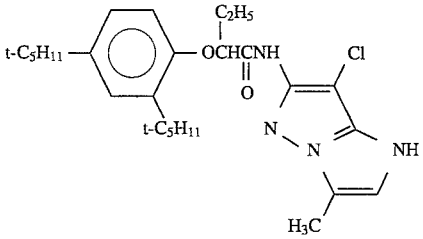
(M-26)
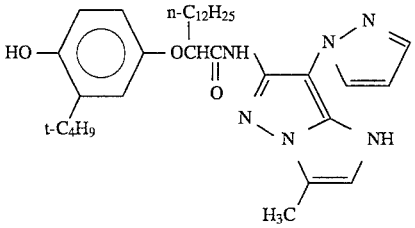
(M-27)
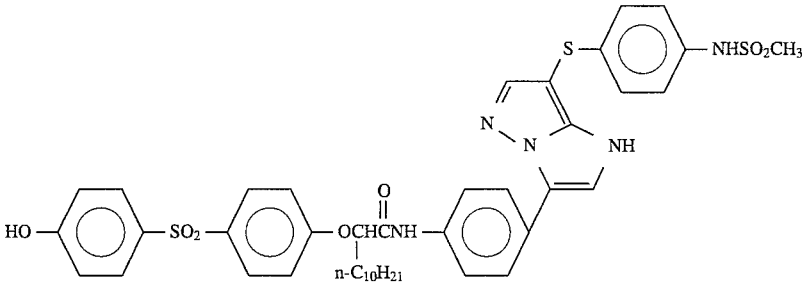

-continued
(M-28)
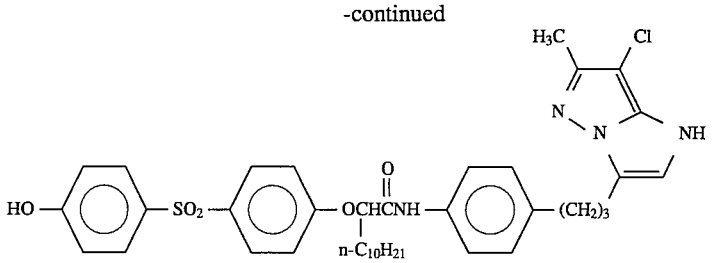
(M-29)
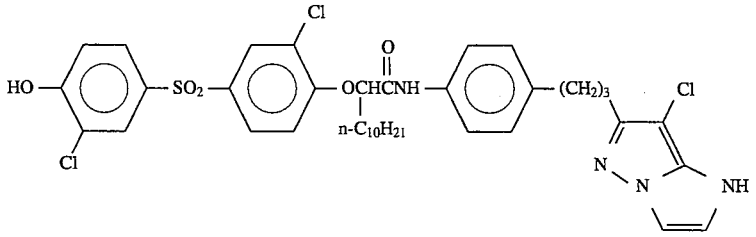
(M-30)
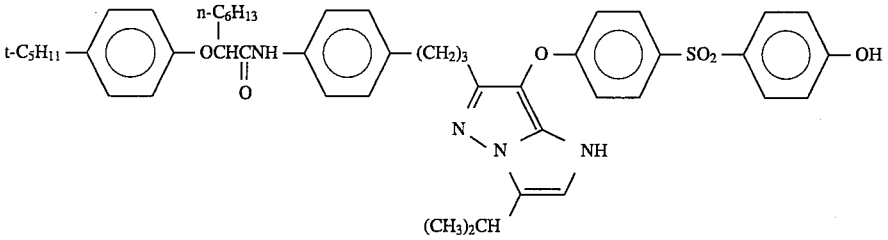
(M-31)
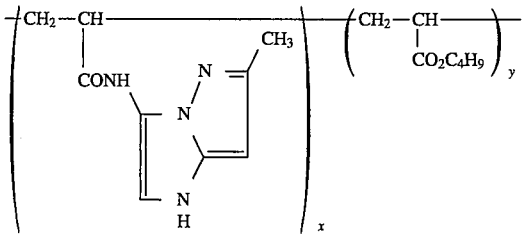
x:y = 50:50
(weight ratio) (The x:y ratio in the following couplers also represents a weight ratio).
(M-32)
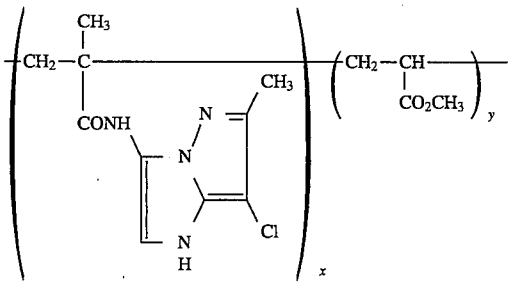
x:y = 40:60
(M-33)
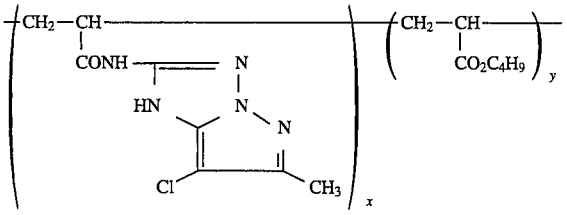
x:y = 50:50
(M-34)
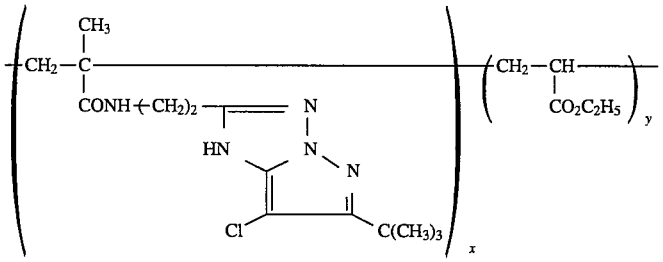
x:y = 55:45

-continued (M-35)

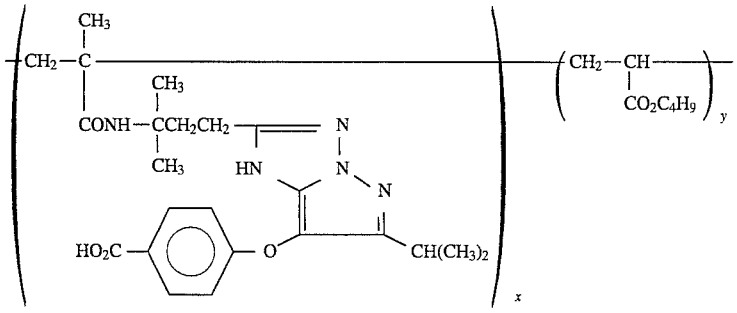

x:y = 50:50

(M-36)

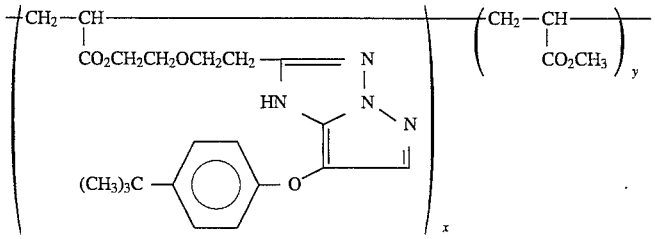

x:y = 45:55

The above-described magenta couplers are generally used in an amount of 0.1 to 1.0 mol, preferably 0.1 to 0.5 mol per mol of silver halide in the silver halide emulsion of the light-sensitive layer.

Typical examples of yellow couplers which can be used in the present invention include oil protect type acylacetamide couplers. Specific examples of these couplers are described in U.S. Pat. Nos. 2,407,210, 2,875,057 and 3,265,506. The use of two equivalent type yellow couplers is preferable in the present invention. Typical examples include oxygen atom elimination type yellow couplers described in U.S. Pat. Nos. 3,408,194, 3,447,928, 3,933,501 and 4,022,620 and nitrogen atom elimination type yellow couplers described in JP-B-58-10739 (the term "JP-B" as used herein means an "examined Japanese patent publication"), U.S. Pat. Nos. 4,401,752 and 4,326,024, *Research Disclosure* 18053 (April 1979), U.K. Patent 1,425,020 and West German Patent Laid-Open Nos. 2,219,917, 2,261,361, 2,329,587 and 2,433,812. Of the yellow couplers, α-pivaloylacetanilide couplers, represented by the following general formula (Y), are particularly preferred because they result in developed dyes having excellent fastness, particularly fastness to light.

(Y)

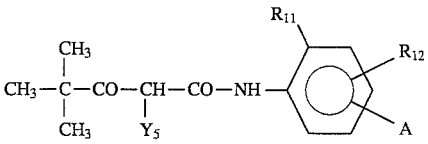

In general formula (Y), $R_{11}$ is a halogen atom, an alkoxy group, a trifluoromethyl group or an aryl group; $R_{12}$ is a hydrogen atom, a halogen atom or an alkoxy group; A is $—NHCOR_{13}$, $—NHSO_2—R_{13}$, $—SO_2NHR_{13}$, $—COOR_{13}$, or $$—SO_2N(R_{14})—R_{13};$$

$R_{13}$ and $R_{14}$ are each an alkyl group, an aryl group or an acyl group; and $Y_5$ is an elimination group (a group which is eliminated). $R_{12}$, $R_{13}$ and $R_{14}$ may be substituted. Examples of substituent groups for $R_{12}$, $R_{13}$ and $R_{14}$ are those described below in the definition of substituent groups for $R_{21}$. The elimination group $Y_5$ is preferably a type which is eliminated through an oxygen atom or a nitrogen atom. The nitrogen atom elimination type is particularly preferred.

Examples of the couplers represented by the general formula (Y) include the following compounds.

(Y-1)
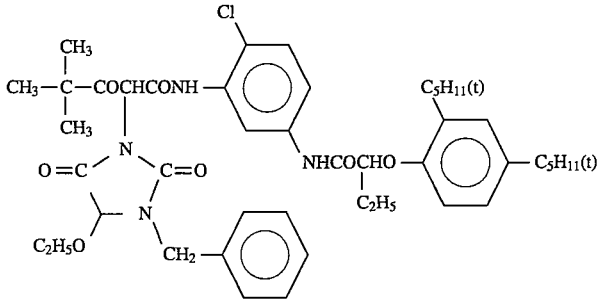
(Y-2)
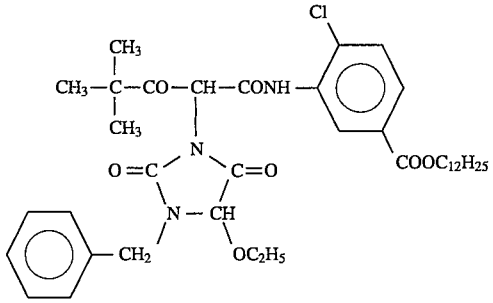
(Y-3)
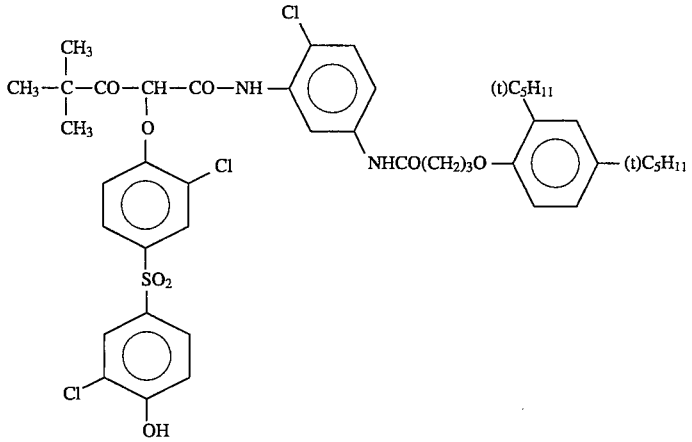
(Y-4)
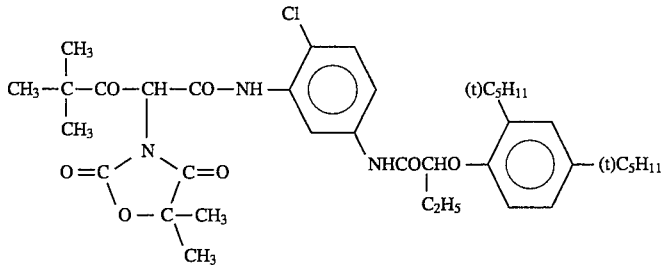
(Y-5)
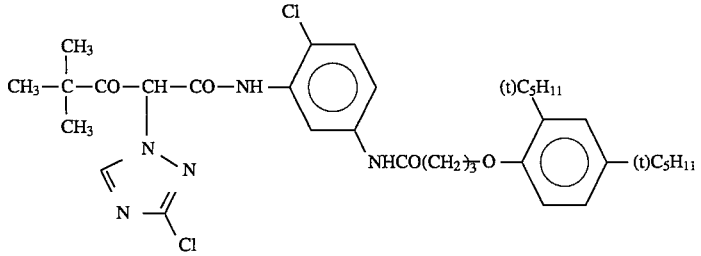

-continued (Y-6)

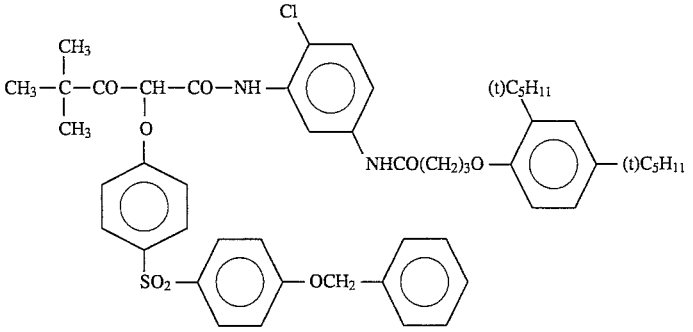

(Y-7)

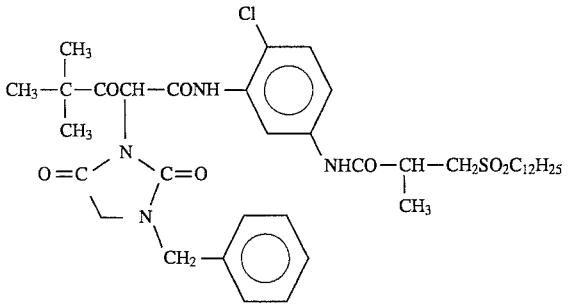

(Y-8)

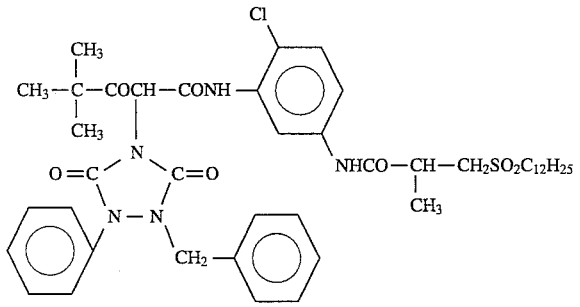

(Y-9)

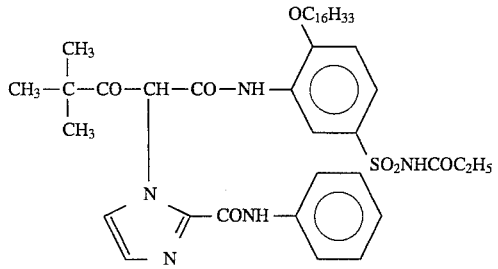

The yellow couplers used in the present invention are coated in an amount of at least 1.1 mmol/m$^2$, preferably from 1.1 to 1.7 mmol/m$^2$ and more preferably from 1.1 to 1.4 mmol/m$^2$ in the yellow coupler containing silver halide emulsion layer of the present invention. When the amount is less than 1.1 mmol/m$^2$, the yellow hue of the color image is deteriorated after storage under moist heat conditions.

Although the use of oil as a coupler dispersion medium is described hereinafter, it is preferred to use as small an amount of oil as possible in the yellow coupler containing silver halide emulsion layer. A preferable ratio by weight of oil/coupler is not higher than 0.32, and more preferably from 0 to 0.32.

It is preferred that the amount of gelatin in the yellow coupler-containing silver halide emulsion layer is not too small in comparison with the amount of oil or oil-soluble component such as the coupler. The ratio by weight of gelatin/oil or oil-soluble component such as the coupler is preferably not lower than 1.0, and more preferably from 1.0 to 2.0.

The color photographic material of the present invention comprises at least one blue-sensitive silver halide emulsion layer, at least one green-sensitive silver halide emulsion layer and at least one red-sensitive silver halide emulsion layer coated on a support. In general-purpose color photographic paper, these layers are coated in the above-described order on the support. However, the order may be changed. Further, an infrared-sensitive silver halide emulsion layer may be used in place of at least one of the above-described emulsion layers.

Color reproduction by substractive color photography can be accomplished by incorporating silver halide emulsions having sensitivity in the respective wavelength regions and color couplers which produce dyes forming complementary colors to light to be exposed (namely, color coupler forming yellow color to blue, color coupler forming magenta color to green and color coupler forming cyan color to red) in these light-sensitive emulsions. If desired, a different constitution may be used in that the sensitive layers do not correspond to the hues of the developed colors of the couplers.

Silver halide emulsions composed of silver chloride or silver chlorobromide containing substantially no silver iodide are preferred in the present invention. The term "containing substantially no silver iodide" as used herein means that the content of silver iodide is not higher than 1 mol %, preferably 0.2 mol %.

The halogen compositions of grains in the emulsion may be the same or different from one another. However, when emulsions comprising grains having the same halogen composition are used, uniform grains can be easily obtained.

With regard to the silver halide composition distribution in the interiors of the grains in the silver halide emulsions, there can be used uniform structure type grains, wherein the silver halide composition is equal throughout the whole of grain; lamination structure type grains, wherein a core in the interior of the silver halide grain, is different in halogen composition from a shell (single layer or multi-layer) surrounding the core; and grains having such a structure that an area having a different halogen composition exists in a non-layered form in the interior of grain or on the surface thereof (when this area exists on the surface of a grain, the grain has such a structure that an area having a different halogen composition is joined to the edge, corner or surface of the grain). To obtain high sensitivity, the latter two types are advantageous rather than the uniform structure type grains. Further, the latter two types are preferable from the viewpoint of pressure resistance.

When grains having a non-uniform structure as described above are used, the boundary part between areas having different halogen compositions from each other may be a clear boundary or an indistinct boundary in which a mixed crystal is formed due to the difference in the composition. Alternatively, the boundary part may be a boundary having a continuous change in structure.

The high silver chloride emulsions used in the present invention have a silver chloride content of preferably not less than 90 mol %, more preferably not less than 95 mol %.

It is preferred that the high silver chloride emulsions have such a structure that grains have silver bromide-localized phases in a laminar or non-laminar form in the interiors of the silver halide grains or on the surfaces thereof. With regard to the halogen composition of the localized phases, the localized phases have a silver bromide content of preferably at least about 10 mol %, more preferably higher than about 20 mol %. These localized phases may exists in the interiors of grains or on the edges, corners or planes of the surfaces of grains. In a preferred embodiment, the localized phases are those formed on the corners of grains by epitaxial growth.

Uniform structure type grains, having a narrow halogen composition distribution, can preferably be used for the purpose of preventing a lowering in sensitivity when pressure is applied to the photographic materials.

The silver chloride content of the silver halide emulsions can be increased to reduce the replenishment rates of developing solutions. In this case, emulsions comprising nearly pure silver chloride, having a silver chloride content of 98 to 100%, can preferably be used.

Silver halide grains contained in the silver halide emulsions of the present invention preferably have a mean grain size of about 0.1 to about 2 μm (grain size is defined as the diameter of a circle equal to the projected area of a grain, and mean grain size is the number average of the diameters).

Monodisperse emulsions are preferred, wherein the coefficient of variation (a value obtained by dividing the standard deviation in grain size distribution by mean grain size) in grain size distribution is not higher than about 20%, preferably not higher than about 15%.

It is preferred that the monodisperse emulsions are mixed to include into the same layer or coated separately so as to form different layers.

The silver halide grains in the photographic emulsions of the present invention may have a regular crystal form such as a cube, a tetradecahedron or an octahedron form, an irregular crystal form such as a sphere or tabular form or a composite crystal form of these crystal forms. A mixture of grains having various crystal forms can be used, but it is preferred that the grains are composed of at least about 50%, preferably at least about 70%, more preferably at least about 90%, of grains having a regular crystal form.

There can be preferably used emulsions wherein tabular grains having an aspect ratio (a ratio of diameter in terms of circle/thickness) of not lower than about 5, preferably not lower than about 8, account for at least about 50% of the projected area of the entire grains.

Silver chlorobromide emulsions which are used in the present invention can be prepared by the methods described in P. Glafkides, *Chimie et Physique Photographique* (Paul Montel, 1967), G. F. Dufffin, *Photographic Emulsion Chemistry* (Focal Press, 1966) and V. L. Zelikman et al., *Making and Coating Photographic Emulsion* (Focal Press, 1964). Specifically, an acid process, neutral process or ammonia process can be used.

A soluble salt and a soluble halide can be reacted in accordance with the single jet process, double jet process or a combination thereof. A reverse mixing method can be used in which grains are formed in the presence of an excess of silver ions, or a controlled double jet process can be used in which a constant pAg value is maintained in the liquid phase in which silver halide is formed. According to the controlled jet process, silver halide emulsions can be obtained in which the grains have a regular crystal form and the grain size is nearly uniform.

Various polyvalent metal ion impurities can be introduced into the silver halide emulsions of the present invention during the course of the formation of the grains or the physical ripening of the grains. Examples of suitable compounds include salts of cadmium, zinc, lead, copper and thallium, and salts and complex salts of Group VIII metals such as iron, ruthenium, rhodium, palladium, osmium, iridium and platinum. Group VIII metal ions are particularly preferred. The amounts of these compounds to be added vary widely depending on the purpose, but are preferably about $10^{-9}$ to about $10^{-2}$ mol per mol of silver halide.

Silver halide emulsions which are used in the present invention are usually subjected to chemical sensitization and spectral sensitization.

Examples of chemical sensitization include sulfur sensitization, typically wherein unstable sulfur compounds are added; noble metal sensitization, typically gold sensitization; and reduction sensitization. These chemical sensitization methods may be used either alone or in combination. Preferred compounds which can be used for chemical sensitization are described in JP-A- 62-215272 (right lower column of page 18 to right upper column of page 22).

Spectral sensitization is carried out to impart spectral sensitivity in the desired wavelength region of light to the emulsion of each layer of the photographic material of the present invention. Preferably, spectral sensitization is carried out by adding spectral senstizing dyes that absorb light in a wavelength region corresponding to the intended spectral sensitivity. Examples of the spectral sensitizing dyes include those described in F. M. Harmer, *Heterocyclic Compounds— Cyanine Dyes and Related Compounds*, John Wiley & Sons (New York, London, 1964). More specifically, there can preferably be used compounds and spectral sensitization methods described in the above-described JP-A-62-215272 (pages 22 to 38).

Various compounds or precursors thereof can be added to the silver halide emulsions of the present invention to prevent fog during the manufacturing, storage or processing of the photographic materials or to stabilize photographic performance. Preferred examples of these compounds include those described in the aforesaid JP-A-62-215272 (pages 39 to 72).

The emulsions of the present invention may be either surface latent image type emulsions, in which a latent image is formed mainly on the surface of the grain, and internal latent image type emulsions, in which a latent image is formed mainly in the interior of the grain.

The color photographic materials of the present invention generally contain yellow couplers that form yellow color, magenta couplers that form magenta color and cyan couplers that form cyan color. Each of these couplers forms a color by coupling with an oxidation product of an aromatic amine developing agent.

Cyan couplers which are preferably used in the present invention are compounds represented by the following general formulae (C-I) and (C-II).

(C-I)

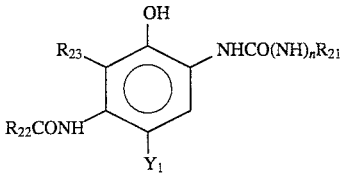

(C-II)

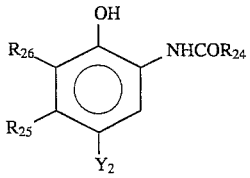

In general formulae (C-I) and (C-II), $R_{21}$, $R_{22}$ and $R_{24}$ are each a substituted or unsubstituted aliphatic, aromatic or heterocyclic group; $R_{23}$, $R_{25}$ and $R_{26}$ are each a hydrogen atom, a halogen atom, an aliphatic group, an aromatic group or an acylamino group; $R_{23}$ and $R_{22}$ may be a non-metallic atomic group for forming a nitrogen-containing 5-membered or 6-membered ring; $Y_1$ and $Y_2$ are each a hydrogen atom or a group which is eliminated by a coupling reaction with an oxidation product of the developing agent; and n is 0 or 1.

In general formula (C-II), $R_{25}$ is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butaneamidomethyl, methoxymethyl.

In general formula (C-I), $R_{21}$ is preferably an aryl group or a heterocyclic group. More preferably, $R_{21}$ is a substituted aryl group. Examples of substituent groups include a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and cyano group.

When $R_{23}$ and $R_{22}$ are not combined together to form a ring, $R_{22}$ in general formula (C-I) is preferably a substituted or unsubstituted alkyl or aryl group and particularly preferably, a substituted aryloxy-substituted alkyl group, and $R_{23}$ is preferably a hydrogen atom.

In general formula (C-II), $R_{24}$ is preferably a substituted or unsubstituted alkyl or aryl group, with a substituted aryloxy-substituted alkyl group being particularly preferred.

In general formula (C-II), $R_{25}$ is preferably an alkyl group having 2 to 15 carbon atoms or methyl group having a substituent group with 1 or more carbon atoms. Preferred examples of the substituent group include an arylthio group, an alkylthio group, an acylamino group, an aryloxy group and an alkyloxy group.

More preferably, $R_{25}$ in general formula (C-II) is an alkyl group having 2 to 15 carbon atoms with an alkyl group having 2 to 4 carbon atoms being particularly preferred.

In general formula (C-II), $R_{26}$ is preferably a hydrogen atom or a halogen atom. A chlorine atom or a fluorine atom are particularly preferred halogens. In general formulae (C-I) and (C-II), $Y_1$ and $Y_2$ are each preferably a hydrogen atom, a halogen atom, an alkoxy group, an aryloxy group, an acyloxy group or a sulfonamido group.

Examples of the couplers represented by general formulae (C-I) and (C-II) include the following compounds.

(C-1)

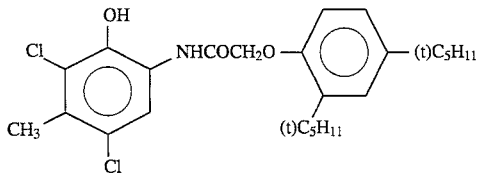

(C-2)

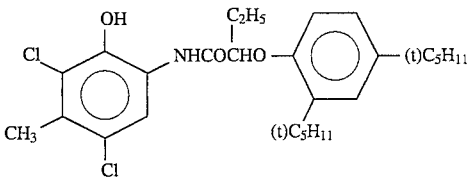

(C-3)

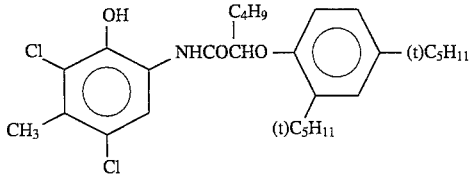

(C-4)

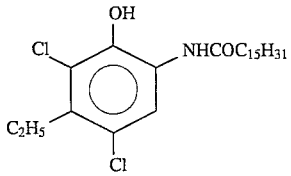

-continued
(C-5)
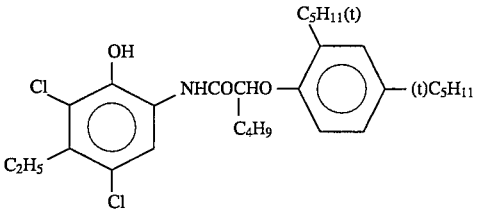
(C-6)
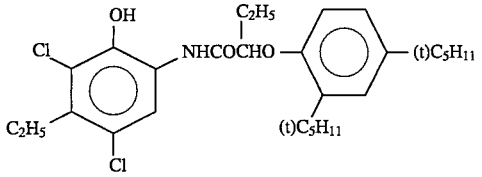
(C-7)
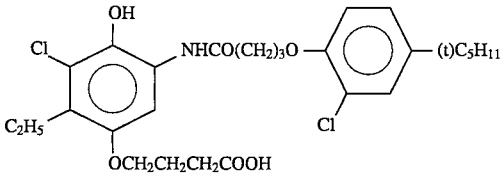
(C-8)
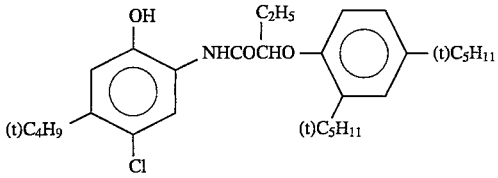
(C-9)
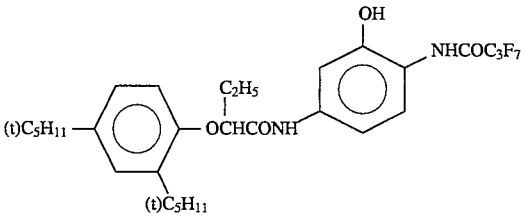
(C-10)
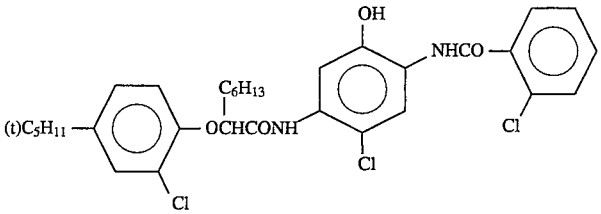
(C-11)
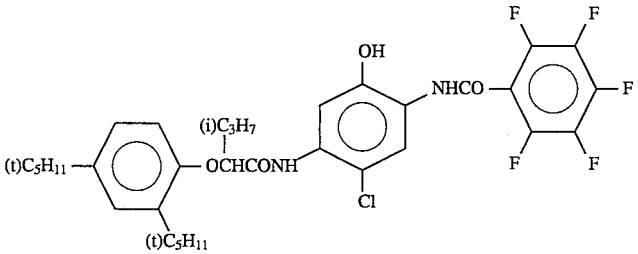
(C-12)
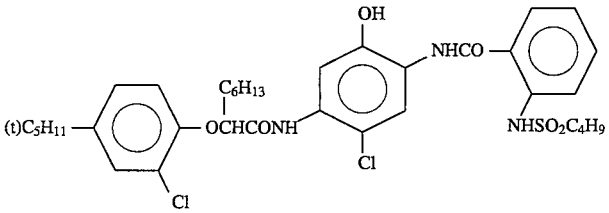
(C-13)
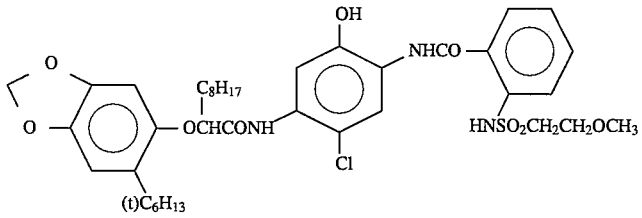

-continued
(C-14)
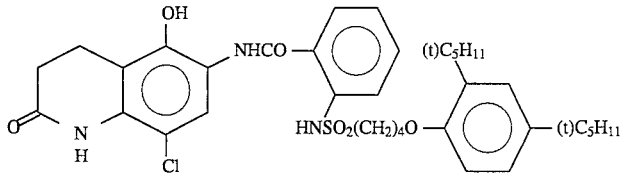
(C-16)
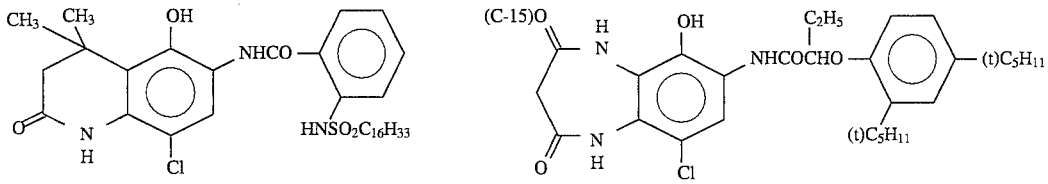
(C-17)
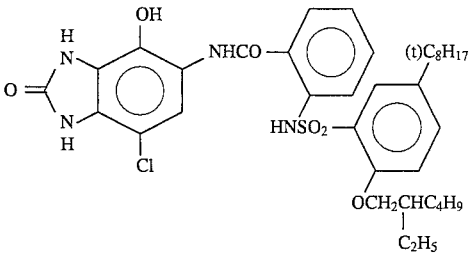
(C-18)
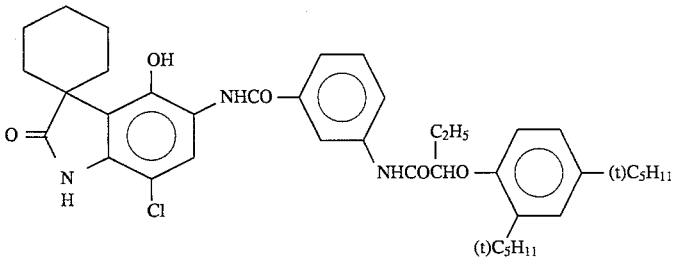
(C-19)
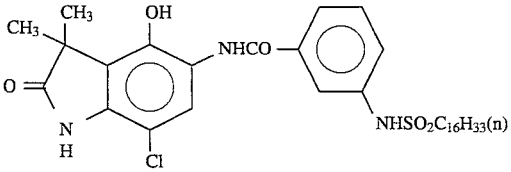
(C-20)
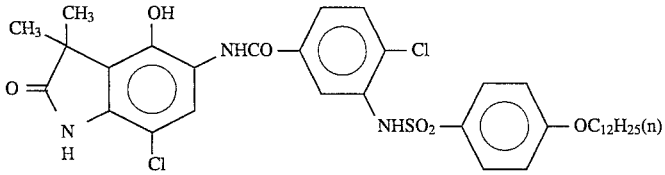
(C-21)
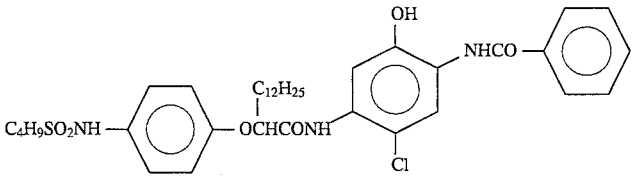

-continued

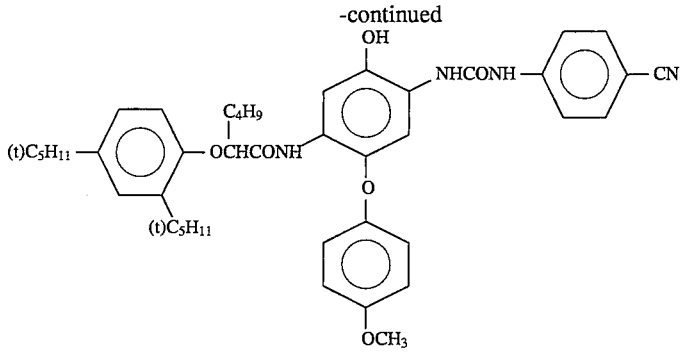

(C-22)

The above-described cyan couplers are incorporated into the silver halide emulsion layers, which form sensitive layers, in an amount of 0.1 to 1.0 mol, preferably 0.1 to 0.5 mol per mol of silver halide.

In the present invention, the above couplers can be added to the sensitive layers by conventional methods. Generally, the couplers can be added by oil-in-water dispersion method known as the oil protect method in which the couplers are dissolved in a solvent, and the resulting solution is emulsified and dispersed in an aqueous gelatin solution containing a surfactant. Alternatively, water or an aqueous gelatin solution is added to a coupler solution containing a surfactant and an oil-in-water dispersion is formed by phase inversion. If desired, alkali-soluble couplers can be dispersed by the Fischer dispersion method. After low-boiling point organic solvents are removed from the coupler dispersions by means of distillation, noodle rinsing or ultrafiltration, the resulting coupler dispersions may be mixed with the photographic emulsions.

High-boiling point organic solvents (oil) having a dielectric constant (25° C.) of about 2 to about 20 and a refractive index (25° C.) of about 1.5 to about 1.7 and/or water-insoluble compounds can preferably be used as dispersion mediums for the couplers.

The high-boiling point organic solvents represented by the following general formulae (A) to (E) are preferably in the present invention used.

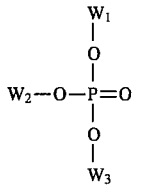

(A)

$W_1-COO-W_2$ (B)

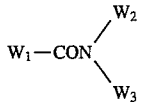

(C)

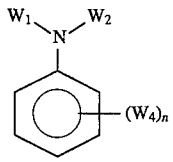

(D)

$W_1-O-W_2$ (E)

In the above formulas, $W_1$, $W_2$ and $W_3$ are each a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or greater, each $W_4$ may be the same or different. In formula (E), $W_1$ and $W_2$ may be combined together to form a condensed ring.

In addition to the above-described high-boiling point organic solvents, compounds that have a melting point of not higher than 100° C. and a boiling point of not lower than 140° C. and are immiscible with water can be used so long as they are good solvents for the couplers. The high-boiling point organic solvents have a melting point of preferably not higher than about 80° C. and a boiling point of preferably not lower than about 160° C., more preferably not lower than about 170° C.

The details of these high-boiling organic solvents are described in JP-A-62-215272 (right lower column of page 137 to right upper column of page 144).

The couplers can be impregnated on and/or in a loadable latex polymer (e.g., described in U.S. Pat. No. 4,203,716) in the presence or absence of the high-boiling point organic solvent, or dissolved in a water-insoluble, organic solvent-soluble polymer and can be emulsified and dispersed in an aqueous solution of hydrophilic colloid.

Preferably, homopolymers or copolymers described in PCT WO 88/00723 (pages 12 to 30) are used. Particularly, acrylamide polymers are preferred for dye image stabilization.

The photographic materials of the present invention may contain hydroquinone derivatives, aminophenol derivatives, gallic acid derivatives and ascorbic acid derivatives as color fogging inhibitors (antifogging agents).

The photographic materials of the present invention may also contain various anti-fading agents. Examples of the anti-fading agents for cyan, magenta and/or yellow images include hydroquinones, 6-hydroxychromans, 5-hydroxycoumarans, spiro-chromans, hindered phenols such as bisphenols and p-alkoxyphenols, gallic acid derivatives, methylenedioxybenzenes, aminophenols, hindered amines and ethers or ester derivatives obtained by silylating or alkylating phenolic hydroxyl group of the above-described compounds. Further, metal complexes such as (bissalicyl-aldoximato)nickel complex and (bis-N,N-dialkyldithiocarbamato)nickel can also be used.

Examples of the organic anti-fading agents include hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxycoumarans and spiro-chromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, methylenedioxybenzenes and aminophenols described in U.S. Pat. Nos. 3,457,079 and 4,332,886 and JP-B-56-21144; hindered amines described in U.S. Pat. Nos. 3,336,135 and 4,268,593, U.K. Patents 1,322, 889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241, 153 and U.K. Patent 2,027,731 (A).

These compounds are used in an amount of generally about 5 to about 100% by weight based on the amount of the corresponding coupler. These compounds are co-emulsified with the couplers and added to the light sensitive layers.

It is preferred that an ultraviolet light absorbing agent is introduced into the cyan color forming layer and into both layers which are adjacent to the cyan color forming layer to prevent the cyan color image from being deteriorated by heat and particularly light.

Examples of the ultraviolet light absorbing agents include aryl group-substituted benztriazole compounds described in U.S. Pat. No. 3,533,794; 4-thiazolidone compounds described in U.S. Pat. Nos. 3,314,794 and 3,352,681; benzophenone compounds described in JP-A-46-2784; cinnamic ester compounds described in U.S. Pat. Nos. 3,705, 805 and 3,707,375; butadiene compounds described in U.S. Pat. No. 4,045,229; and benzoxydol compounds described in U.S. Pat. Nos. 3,406,070, 3,677,652 and 4,271,307. If desired, ultraviolet absorbing couplers (e.g., α-naphthol cyan color forming couplers) and ultraviolet light absorbing polymers may be used. These ultraviolet light absorbing agents may be mordanted in specific layers.

Aryl group-substituted benztriazole compounds are preferred as the ultraviolet light absorbing agents.

It is preferred that the following compounds are used in combination with the above-described couplers, particularly pyrazoloazole couplers.

Specifically, it is preferred that a compound (F) and/or a compound (G) are/is used. Compound (F) is a compound which forms a chemical bond to an aromatic amine developing agent that is left after color development to form a compound which is chemically inactive and substantially colorless. Compound (G) is a compound which forms a chemical bond to an oxidation product of the aromatic amine developing agent left after color development to form a compound which is chemically inactive and substantially colorless. When the compound (F) and/or the compound (G) are used alone or in combination, staining and other side effects can be prevented. These side effects are caused by the formation of colored dyes by the coupling reaction of the couplers with the color developing agents or the oxidants thereof during storage after processing, as a result of the fact that small amounts of the couplers and color developing agents or the oxidants thereof are left behind in the layers.

Of the compounds (F), compounds having a second-order reaction constant $k_2$ (in trioctyl phosphate at 80° C.) (in terms of the reaction with p-anisidine) of 1.0 l/mol·sec to $1\times10^{-5}$ l/mol·sec are preferred. The second-order reaction constant can be measured by the method described in JP-A-63-158545.

When $k_2$ is larger than the above upper limit, the compounds (F) become unstable and there is a possibility that they will react with gelatin or water and decompose. However, when $k_2$ is smaller than the above lower limit, the reaction of compound (F) with the aromatic amine developing agent left behind is retarded. As a result, the side effects of the aromatic amine developing agent left behind can not be prevented.

Of the compounds (F), compounds represented by the following general formula (FI) or (FII) are more preferable.

$$R_1-(A)_n-X \quad \text{(FI)}$$

$$R_2-\underset{\underset{B}{|}}{C}=Y \quad \text{(FII)}$$

In the above formulae, $R_1$ and $R_2$ are each an aliphatic group, an aromatic group, or a heterocyclic group; n is 0 or 1; A is a group which reacts with an aromatic amine developing agent to form a chemical bond; X is a group which is eliminated by the reaction with an aromatic amine developing agent; B is a hydrogen atom, an aliphatic group, an aromatic group, a heterocyclic group, an acyl group or a sulfonyl group; Y is a group which accelerates the addition of an aromatic amine developing agent to the compound of formula (FII); and $R_1$ and X, or Y and $R_2$ or B may be combined together to form a ring structure.

Typical reaction mechanisms for chemically bonding the compounds (F) to the aromatic amine developing agents left behind are substitution reaction and addition reaction.

Preferred examples of the compounds represented by general formulae (FI) and (FII) are those described in JP-A-63-158545, JP-A-62-283338 and European Patent Laid-Open Nos. 298,321 and 277,589.

Among compounds (G) which chemical bond to the oxidation products of the aromatic amine developing agents left after color development to form a compound which is chemically inactive and substantially colorless, compounds represented by the following general formula (GI) are more preferred:

$$R-Z \quad \text{(GI)}$$

wherein R is an aliphatic group, an aromatic group or a heterocyclic group; and Z is a nucleophilic group or a group which is decomposed in the photographic material to release a nucleophilic group. There are preferred compounds of formula (GI) where Z is a group having a Pearson's nucleophilic $^nCH_3I$ value (R. G. Pearson et al, *J. Am. Chem. Soc.*, 90, 319(1968)) of 5 or above or a group derived therefrom.

Preferred examples of the compound represented by general formula (GI) are described in European Patent Laid-Open No. 255,722, JP-A-62-143048, JP-A-62-229145, Japanese Patent Application Nos. 63-136724, JP-A-1-57259 and European Patent Laid-Open Nos. 298,321 and 277,589.

The details of the combined use of compound (G) with compound (F) are described in European Patent Laid-Open No. 277,589.

The hydrophilic colloid layers of the photographic materials of the present invention may contain water-soluble dyes as filter dyes or for the purposes of preventing irradiation or halation. These layers may also contain dyes which are converted into water-soluble dyes by photographic processing.

Examples of the dyes include oxonol dyes, hemioxonol dyes, styryl dyes, merocyanine dyes, cyanine dyes and azo dyes. Of these, oxonol dyes, hemioxonol dyes and merocyanine dyes are preferred.

Any lime-processed gelatin and acid-processed gelatin can be used. The preparation of gelatin is described in more detail in Arthur, Weiss, *The Macromolecular Chemistry of Gelatin* (Academic Press 1964).

Any transparent film, such as cellulose nitrate film and polyethylene terephthalate film, or a reflection type support can be used as supports in the present invention. For the purpose of the present invention, the reflection type support is preferable.

The term "reflection type support" as used herein refers to supports which enhance reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein. Typical examples of the supports include baryta paper, polyethylene coated paper, polypropylene synthetic paper, transparent supports coated with a reflecting layer or containing a reflection material, such as glass sheet, polyester film such as polyethylene terephthalate film and cellulose triacetate or cellulose nitrate, polyamine films, polycarbonate films, polystyrene films and vinyl chloride resins.

Other reflection type supports having a metallic surface having mirror plane reflectivity or secondary diffuse reflectivity can be used. Preferably, the metallic surface has a spectral reflectance of not lower than about 0.5 in the visible wavelength region. The metallic surface may be roughened or may be made diffusion-reflective by using metallic powder. As the metal, there can be used aluminum, tin, silver, magnesium or alloys thereof.

The metallic surface may be a surface of a metallic sheet obtained by rolling, metallization or plating or a surface of a thin metallic layer or a metallic foil. A metallic surface obtained by metallizing a substrate is preferable. It is preferred that a water-resistance resin layer, particularly a thermoplastic resin layer is provided on the metallic surface. It is also preferred that an antistatic layer is provided on the side of the support which is opposite to the metallic surface side. The details of the supports are described in JP-A-61-210346, JP-A-63-24247, JP-A-63-24251 and JP-A-63-24255. These supports can be chosen according to the intended use.

It is preferred that as the reflecting material, a white pigment is thoroughly kneaded in the presence of a surfactant or the surfaces of pigment particles are treated with a dihydric to tetrahydric alcohol.

The occupied area ratio (%) of fine particles of white pigment per unit area can be determined by dividing an observed area into adjoining unit areas (each unit area being 6 μm×6 μm) and measuring the occupied area ratio (%) (Ri) of the fine particles projected on the unit area. A coefficient of variation of the occupied area ratio (%) can be determined from the ratio $s/\bar{R}$ of standard deviation s of Ri to the mean value ($\bar{R}$) of Ri. The number (n) of divided unit areas is preferably not smaller than 6. Accordingly, a coefficient of variation $s/\bar{R}$ can be determined by the following formula.

$$\sqrt{\frac{\sum_{i=1}^{n}(Ri-\bar{R})^2}{n-1}} \Big/ \frac{\sum_{i=1}^{n} Ri}{n}$$

In the present invention, a coefficient of variation of the occupied area ratio (%) of the fine pigment particles is preferably not higher than 0.15, particularly not higher than 0.12. When the value is not higher than 0.08, the dispersion of the particles is considered substantially uniform.

It is preferred that the color photographic materials of the present invention are subjected to color development, bleaching-fixing and rinsing treatment (or stabilizing treatment). Bleaching and fixing may be carried out with one bath or separately.

Color developing solutions which are used in the present invention contain a conventional aromatic primary amine color developing agent. Preferred examples thereof are p-phenylenediamine compounds. Typical examples thereof include, but are not limited to, the following compounds.

D-1: N,N-Diethyl-p-phenylenediamine
D-2: 2-Amino-5-diethylaminotriene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(8-hydroxyethyl)amino] aniline
D-6: 4-Amino-3-methyl-N-ethyl-N-[β-(methanesulfonamido)ethyl] aniline
D-7: N-(2-Amino-5-diethylaminophenylethyl-)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-8-ethoxyethylaniline
D-11: 4-Amino-3-methyl-N-ethyl-N-8-butoxyethylaniline Among the above-described p-phenylenediamine compounds, 4-amino-3-methyl-N-ethyl-N-[β-(methanesulfonamido)ethyl]aniline (compound D-6) is particularly preferred.

These p-phenylenediamine compounds may be in the form of a salt such as sulfates, hydrochlorides, sulfites or p-toluenesulfonates. The aromatic primary amine developing agents are used in a concentration of preferably about 1 to about 20 g, more preferably about 0.5 to about 10 g per liter of the developing solution.

In the practice of the present invention, it is preferred that the developing solutions used contain substantially no benzyl alcohol. The term "containing substantially no benzyl alcohol" as used herein means that the concentration of benzyl alcohol is preferably not more than about 2 ml, more preferably not more than about 0.5 ml per liter of the developing solution. It is most preferred that the developing solutions are completely free from benzyl alcohol.

It is preferred that the developing solutions used in the practice of the present invention also contain substantially no sulfite ion. The sulfite ion functions as a preservative for developing agents and at the same time, it has the effects of dissolving silver halide and lowering dye forming efficiency by reacting with the oxidation products of the developing agents. It is considered that the increase in the fluctuation of photographic characteristics in continuous processing is partly caused by these effects. The term "containing substantially no sulfite ion" as used herein means that the concentration of sulfite ion is preferably not more than $3.0\times10^{-3}$ mol/l. It is most preferred that the developing solutions are completely free from sulfite ion.

In the present invention, however, the above definition of the amount of sulfite ion excludes a very small amount of sulfite ion which is used for the prevention of the oxidation of a processing agent kit in which the developing agent is concentrated before the preparation of a working solution.

It is more preferred that the developing solutions of the present invention contain substantially no hydroxylamine. This is because although hydroxylamine functions as a preservative for the developing solutions, it has a silver development activity and photographic characteristics are greatly affected by fluctuation in the concentration of hydroxylamine. The term "containing substantially no hydroxylamine" as used herein means that the concentration of hydroxylamine is preferably not more than about $5.0\times10^{-3}$ mol/l. It is most preferred that the developing solutions are completely free from hydroxylamine.

It is most preferred that the developing solutions used in the present invention contain organic preservatives in place of hydroxylamine or sulfite ion.

The term "organic preservative" as used herein refers to all organic compounds which reduce the deterioration rate of the aromatic primary amine color developing agents when added to the processing solutions for color photographic materials. Specifically, the organic preservatives are organic compounds which are capable of preventing the color developing agents from being oxidized by air, etc.

Of these, particularly effective organic preservatives are hydroxylamine derivatives (excluding hydroxylamine; hereinafter, the same applies to the term "hydroxylamine derivatives"), hydroxamic acids, hydrazines, hydrazides, phenols, α-hydroxyketones, α-aminoketones, saccharide, monoamines, diamines, polyamines, quaternary ammonium salts, nitroxy radicals, alcohols, oximes, diamide compounds and condensed ring type amines. These compounds are described in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

If desired, other preservatives such as various metals described in JP-A-57-44148 and JP-A-57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544 may be optionally used. It is particularly preferred that alkanolamines such as triethanolamine, dialkylhydroxylamines such as diethylhydroxylamine, hydrazine derivatives or aromatic polyhydroxy compounds are added.

Among the above-described organic preservatives, hydroxylamine derivatives and hydrazine derivatives (hydrazine and hydrazides) are particularly preferred. The details thereof are described in JP-A-1-97953, JP-A-1-186939, JP-A-1-186940 and JP-A-1-187557.

It is more preferred for the purpose of improving the stability of the color developing solutions, that is, improving stability during continuous processing, that the above-described hydroxylamine derivatives or hydrazine derivatives are used in combination with amines. Examples of the amines include cyclic amines described in JP-A-63-239447, amines described in JP-A-63-128340 and amines described in JP-A- 1-186939.

It is preferred that the color developing solutions of the present invention contain chlorine ion in an amount of about $3.5\times10^{-2}$ to about $1.5\times10^{-1}$ mol/l, more preferably about $4\times10^{-2}$ to about $1\times10^{-1}$ mol/l. When the concentration of chlorine ion is higher than about $1.5\times10^{-1}$ mol/l, development is retarded and therefore, the purpose of rapidly processing and providing high Dmax according to the present invention cannot be achieved. When the concentration of chlorine ion is lower than about $3.5\times10^{-2}$ mol/l, fogging cannot be sufficiently prevented.

It is also preferred that the color developing solutions of the present invention contain bromine ion in an amount of about $3.0\times10^{-5}$ to about $1.0\times10^{-3}$ mol/l, more preferably about $5.0\times10^{-5}$ to about $5\times10^{-4}$ mol/l. When the concentration of bromine ion is higher than about $1.0\times10^{-3}$ mol/l, development is retarded and maximum density and sensitivity are lowered. When the concentration is lower than about $3.0\times10^{-5}$ mol/l, fogging cannot be sufficiently prevented.

Chlorine ion and bromine ion may be added directly to the developing solutions or dissolved out of the photographic materials into the developing solutions during development.

When adding chlorine ion directly to the color developing solutions, suitable examples of chlorine ion supply materials include sodium chloride, potassium chloride, ammonium chloride, lithium chloride, nickel chloride, magnesium chloride, manganese chloride, calcium chloride and cadmium chloride. Of these, sodium chloride and potassium chloride are preferred. In addition, chlorine ion may be fed from a fluorescent brightener contained in the developing solutions.

Examples of bromine ion supply materials include sodium bromide, potassium bromide, ammonium bromide, lithium bromide, calcium bromide, magnesium bromide, manganese bromide, nickel bromide, cadmium bromide, cerium bromide and thallium bromide. Of these, potassium bromide and sodium bromide are preferred.

When chlorine ion or bromine ion is to be dissolved out of the photographic materials during development, chlorine ion and bromine ion may be fed from the emulsions or sources other than the emulsions.

The pH of the color developing solutions of the present invention is preferably about 9 to about 12, more preferably about 9 to about 11.0. The color developing solutions may contain other known compounds which are contained in conventional developing solutions.

It is preferred that various buffering agents are used to maintain the pH in the above range. Examples of the buffering agents include carbonates, phosphates, borates, tetraborates, hydroxybenzoates, glycyl salts, salts of N,N-dimethylglycine, salts of leucine, salts of norleucine, salts of guanine, salts of 3,4-dihydroxyphenylalanine, salts of alanine, aminobutyrates, salts of 2-amino-2-methyl-1,3-propanediol, salts of valine, salts of proline, salts of trishydroxyaminomethane and salts of lysine. Of these, carbonates, phosphates, tetraborates and hydroxybenzoates are particularly preferred as the buffering agents, because they have excellent solubility and buffer capacity in a high pH region (not lower than 9.0), and they are inexpensive and do not have an adverse effect (e.g., fogging) on photographic performance when added to the color developing solutions.

Examples of the buffering agents include sodium carbonate, sodium bicarbonate, potassium bicarbonate, sodium tertiary phosphate, potassium tertiary phosphate, disodium hydrogenphosphate, dipotassium hydrogen-phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2 -hydroxybenzoate (potassium 5-sulfosalicylate). However, the buffering agents which can be used in the present invention are not limited to the above-described compounds.

The amounts of the buffering agents to be added to the color developing solutions are preferably not less than about 0.1 mol/l, more preferably about 0.1 to about 0.4 mol/l.

The color developing solutions may contain various chelating agents as the suspending agents of calcium or magnesium or to improve the stability of the color developing solutions. Examples of the chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diminetetraacetic acid, ethylenediamine-o-hydroxyphenylacetic acid, 2-phosphonobutane- 1,2,4-tricarboxylic acid, 1-hydroxyethylidene-1,1-diphosphonic acid and N,N'-bis(2-hydroxybenzyl)ethylenediamine-N,N'-diacetic acid. If desired, these chelating agents may be used in combination of two or more.

The chelating agents may be used in an amount sufficient to sequester metal ions in the color developing solutions. For example, the chelating agents can be used in an amount of about 0.1 to about 10 g/l.

If desired, the color developing solutions may contain development accelerators.

Examples of the development accelerators which can be used in the present invention include thioether compounds described in JP-B-37-16088, JP-B-37-5987, JP-B-38-7826, JP-B-44-12380, JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; and 1-phenyl-3-pyrazolidone compounds and imidazoles.

If desired, anti-fogging agents may be added to the present invention. Examples of the anti-fogging agents include alkali metal halides such as sodium chloride, potassium bromide and potassium iodide and organic anti-fogging agents. Typical examples of the organic anti-fogging agents include nitrogen-containing heterocyclic compounds such as benztriazole, 6-nitrobenzimidazole, 5-nitroisoindazole, 5-methylbenztriazole, 5-nitrobenztriazole, 5-chlorobenztriazole, 2-thiazolylbenzimidazole, 2-thiazolylmethyl-benzimidazole, indazole, hydroxyazaindolizine and adenine.

It is preferred that color developing solutions which are used in the present invention contain fluorescent brighteners. Preferred examples of the fluorescent brighteners include 4,4'-diamino-2,2'-disulfostilbene compounds. The fluorescent brighteners are used in an amount of 0 to 5 g/l, preferably 0.1 to 4 g/l.

If desired, surfactants such as alkylsulfonic acids, arylsulfonic acids, aliphatic carboxylic acids and aromatic carboxylic acids may optionally be added.

The processing temperature of the color developing solutions used in the present invention is generally about 20° to about 50° C., preferably about 30° to about 40° C. The processing time is generally from about 20 sec to about 5 min, preferably from about 30 sec to about 2 min. A low replenishment rate is preferred. The replenishment rate of the developing solutions is generally about 20 to about 600 ml, preferably about 50 to about 300 ml, more preferably about 60 to about 200 ml, most preferably about 60 to about 150 ml per $m^2$ of the photographic material.

The desilverization stage of the present invention will be illustrated below.

Generally, any of the following techniques (a) to (d) can be used for desilverization: (a) bleaching step-fixing step, (b) fixing step-bleach-fixing step, (c) bleaching step-bleach-fixing step and (d) bleach-fixing step.

Bleaching solutions, bleach-fixing solutions and fixing solutions which can be used in the present invention will be illustrated below.

Any bleaching agent can be used in the bleaching solutions or the bleach-fixing solutions. Particularly preferred examples of the bleaching agents include organic complex salts of iron(III) (e.g., complex salts of aminopolycarboxylic acids such as ethylenediaminetetraacetic acid and diethylenetriaminepentaacetic acid, aminopolyphosphonic acids, phosphonocarboxylic acids and organic phosphonic acids), complex salts of organic acids such as citric acid, tartaric acid and malic acid; persulfates; and hydrogen peroxide.

Of these, organic complex salts of iron(III) are particularly preferred for the purpose of rapid processing and prevention of environmental pollution. Examples of useful aminopolycarboxylic acids, aminopolyphosphonic acids, organic phosphonic acids and salts thereof which are used for the formation of the organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diamineteraacetic acid. These compounds may be in the form of sodium, potassium, lithium or ammonium salt. Of these compounds, iron(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred because these compounds have high bleaching power. These ferric ion complex salts may be used in the form of a complex salt, or may be formed in the solution by using a ferric salt such as ferric sulfate, ferric chloride, ferric nitrate, ammonium iron(III) sulfate or ferric phosphate with a chelating agent such as an aminopolycarboxylic acid, an aminopolyphosphonic acid or a phosphonocarboxylic acid. The chelating agents may be used in an amount greater than that required for the formation of the iron(III) complex salts. Of the complex salts, the iron complex salts of the aminopolycarboxylic acids are preferred. The complex salts are used in an amount of about 0.01 to about 1.0 mol/l, preferably about 0.05 to about 0.50 mol/l.

If desired, the bleaching solutions, the bleach-fixing solutions and/or pre-bath thereof may contain various compounds as bleaching accelerators. Examples of the bleaching accelerators include compounds having a mercapto group or disulfide bond as described in U.S. Pat. No. 3,893,858, German Patent 1,290,812, JP-A-53-95630 and *Research Disclosure* No. 17129 (July 1978); thiourea compounds described in JP-B-45-8506, JP-A-52-20832, JP-A-53-32735 and U.S. Pat. No. 3,706,561; and halides such as iodine and bromine ions. These compounds are preferred because they have excellent bleach accelerating power.

The bleaching solutions or bleach-fixing solutions of the present invention may contain rehalogenating agents such as bromides (e.g., potassium bromide, sodium bromide, ammonium bromide), chlorides (e.g., potassium chloride, sodium chloride, ammonium chloride) and iodides (e.g., ammonium iodide). If desired, one or more inorganic and organic acids having a pH buffering capacity such as borax, sodium metaborate, acetic acid, sodium acetate, sodium carbonate, potassium carbonate, phosphorous acid, phosphoric acid, sodium phosphate, citric acid, sodium citrate, tartaric acid and alkali metal or ammonium salts thereof or corrosion inhibitors such as ammonium nitrate and guanidine may be added.

Fixing agents which can be used in the bleach-fixing solutions or the fixing solutions in the present invention include conventional fixing agents such as thiosulfates (e.g., sodium thiosulfate, ammonium thiosulfate); thiocyanates (e.g., sodium thiocyanate, ammonium thiocyanate); and water-soluble silver halide-dissolving agents (e.g., thioether compounds such as ethylenebisthioglycolic acid, 3,6-dithia-1,8-octanediol and thioureas). These compounds may be used either alone or as a mixture of two or more.

Further, specific bleach-fixing solutions composed of a combination of a large amount of a halide such as potassium iodide with a fixing agent as described in JP-A-55-155354 can be used. Thiosulfates, particularly ammonium thiosulfate are preferable in the present invention. The fixing agents are used in an amount of preferably about 0.3 to about 2 mol/l, more preferably about 0.5 to about 1.0 mol/l. The pH of the bleach-fixing solutions or the fixing solutions is preferably in about 3 to about 10, more preferably about 5 to about 9.

The bleach-fixing solutions may contain a fluorescent brightener, an anti-foaming agent, and a surfactant and organic solvent, such as polyvinyl pyrrolidone and methanol.

It is preferred that the bleach-fixing solutions or the fixing solutions contain, as a preservative, sulfite ion-releasing compounds such as sulfites (e.g., sodium sulfite, potassium sulfite, ammonium sulfite), bisulfites (e.g., ammonium bisulfite, sodium bisulfite, potassium bisulfite) and metabisulfites (e.g., potassium metabisulfite, sodium metabisulfite, ammonium metabisulfite). These compounds are preferably used in an amount of about 0.02 to about 0.05 mol/l, more preferably about 0.04 to about 0.40 mol/l in terms of sulfite ion.

Generally, sulfites are used as a preservative, but other compounds such as ascorbic acid, carbonylsulfite adduct or carbonyl compound may be added.

Further, buffering agents, fluorescent brighteners, chelating agents, anti-foaming agents, mildew-proofing agents, etc. may be added.

Generally, rinsing and/or stabilization treatment are/is carried out after desilverization such as after the fixing or bleach-fixing stage.

The amount of rinsing water in the washing stage varies widely depending on the characteristics (e.g., depending on materials used such as couplers) of the photographic materials, use, the temperature of rinsing water, the number of rinsing tanks (the number of stages), the replenishing system (countercurrent, direct flow) and other conditions. The relationship between the amount of water and the number of rinsing tanks in the multi-stage countercurrent system can be determined by the method described in *Journal of the Society of Motion Picture and Television Engineers*, Vol. 64, p. 248–253 (May 1955). The number of stages in the multi-stage countercurrent system is preferably 2 to 6, particularly preferably 2 to 4.

According to the multi-stage countercurrent system, the amount of rinsing water can be greatly reduced. For example, the amount of rinsing water can be reduced to about 0.5 to about 1 l or below per $m^2$ of the photographic material, which is very effective in the present invention. However, this causes a problem in that the residence time of water in the tanks is prolonged. As a result, bacteria are grown and the resulting suspended matter is deposited on the photographic material. A method for reducing calcium ion and magnesium ion described in JP-A-62-288838 can effectively be used to solve the above-mentioned problem. Further, isothiazolone compounds, thiabendazole compounds described in JP-A-57-8542, chlorine-containing germicides such as sodium chlorinated isocyanurate and benztriazole described in JP-A-61-120145 and benztriazole and copper ion described in JP-A- 61-267761 and germicides described in *Chemistry of Germicidal Antifungal Agent*, written by Hiroshi Horiguchi (1986), *Sterilization, Disinfection, Antifungal Technique*, edited by Sanitary Technique Society (1982) and *Antibacterial and Antifungal Cyclopedie*, edited by Nippon Antibacterial Antifungal Society (1986), can be used.

The rinsing water used in the present invention may contain a surfactant as wetting agent or chelating agent. For example EDTA can be used as a water softener.

The photographic materials may be subjected to the above-described rinsing stage, or may be directly treated with stabilizing solutions without a rinsing stage. Compounds capable of stabilizing the image are added to the stabilizing solutions. Examples of such compounds include aldehyde compounds such as formalin; buffering agents for adjusting the pH of the layers to a value suitable for stabilizing image; and ammonium compounds. Further, there can be used the above-described germicides and antifungal agents to prevent bacteria from being grown in the solution and to impart antifungal properties to the treated photographic materials.

Further, surfactants, fluorescent brighteners and hardening agents may be added. When the stabilization treatment is directly carried out without the rinsing stage in the treatment of the photographic materials of the present invention, all of the known methods such as described in JP-A-57-8543, JP-A-58-14834 and JP-A-60-220345 can be used.

In a preferred embodiment, a chelating agent such as 1-hydroxyethylidene-1,1-diphosphonic acid or ethylenediaminetetramethylenephosphonic acid and magnesium and bismuth compounds are used.

Similarly, rinse solution can be used as water washing solution or stabilization solution used after desilverization.

The pH of the rinsing stage or the stabilization stage is preferably about 4 to about 10, more preferably about 5 to about 8. The temperature varies depending on the use and characteristics of the photographic materials, but is generally about 15° to about 45° C., preferably about 20° to about 40° C. The time can be arbitrarily set, but a shorter time is preferred for reducing processing time. The processing time for the rinsing stage is preferably from about 15 to about 105 seconds, more preferably from about 30 to about 90 seconds. A lower replenishment rate is preferred from the viewpoints of running cost, the reduction of discharged amount, handling, etc.

Specifically, the replenishment rate for rinsing and stabilization per unit area of the photographic material is preferably about 0.5 to about 50 times, more preferably about 3 to about 40 times the amount brought over from the prebath, or not more than about 1 liter, preferably not more than about 500 ml per $m^2$ of the photographic material. Replenishment may be conducted continuously or intermittently.

The solution used in the rinsing and/or stabilization stage can also be used in a pre-stage. For example, rinsing water is reduced by using a multistage countercurrent system; the overflow solution of rinsing water is allowed to flow into the bleaching-fixing bath which is a pre-bath; and the bleaching-fixing bath is replenished with a concentrated liquid to reduce the amount of waste liquid.

The present invention is now illustrated in greater detail by reference to the following example which, however, is not to be construed as limiting the invention in any way.

EXAMPLE

Both sides of a paper support were laminated with polyethylene. The support was coated with the following layers to prepare a multi-layer color photographic paper Sample A having the following layer structure. Coating solutions were prepared in the following manner.

Preparation of Coating Solution for First Layer 27.2 cc of ethyl acetate and 6.1 g of solvent (Solv-1) were added to 14.9 g of yellow coupler (ExY) to dissolve it. The resulting solution was emulsified and dispersed in 148 cc of a 10% aqueous gelatin solution containing 8 cc of 10% sodium dodecylbenzenesulfonate. Separately, the following blue-sensitive sensitizing dyes were added to a silver chlorobromide emulsion (the emulsion was a 3:7 (by molar ratio in terms of silver) mixture of an emulsion composed of grains (cube, mean grain size: 0.88 μm) and an emulsion composed of grains (cube mean grain size: 0.70 μm); a coefficient of variation in grain size distribution being 0.08 and 0.10; each emulsion having 0.2 mol % of silver bromide-localized phase on the surface of grain). Each blue-sensitive sensitizing dye was used in an amount of $2.0\times10^{-4}$ mol for the larger-size emulsion and $2.5\times10^{-4}$ mol for the smaller-size emulsion, each amount being per mol of silver. The resulting emulsion was then subjected to sulfur sensitization. The above emulsified dispersion and the resulting emulsion were mixed and dissolved. A coating solution for the first layer was prepared so as to give the following composition. Coating solutions for the second layer to the seventh layer were prepared in the same way as in the coating solution for the first coating solution. Sodium salt of 1-oxy-3,5-dichloro-s-triazine was used as the hardening agent for gelation in each layer.

The following spectral sensitizing dyes for the following layers were used.

Blue-sensitive Emulsion Layer

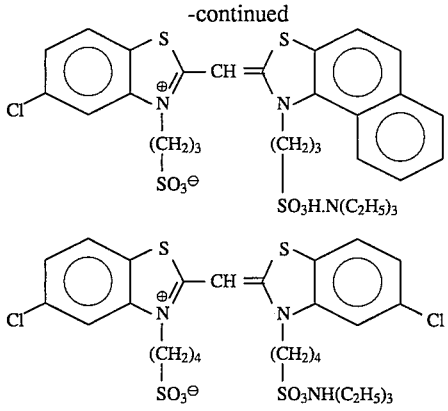

(Each dye was used in an amount of $2.0\times10^{-4}$ mol for the larger-size emulsion and $2.5\times10^{-4}$ mol for the smaller-size emulsion, each amount being per mol of silver halide).

Green-sensitive Emulsion Layer

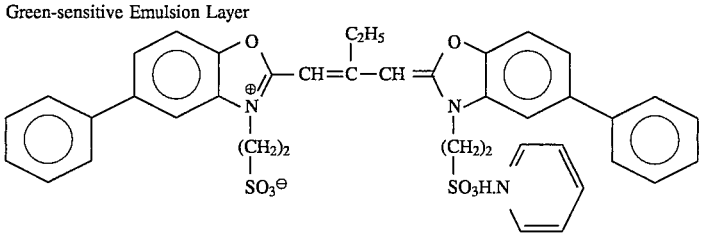

(The dye was used in an amount of $4.0\times10^{-4}$ mol for the larger-size emulsion and $5.6\times10^{-4}$ mol for the smaller-size emulsion, each amount being per mol of silver halide), and

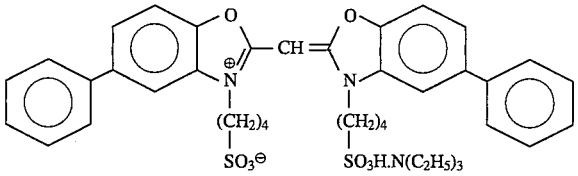

(The dye was used in an amount of $7.0\times10^{-5}$ mol for the larger-size emulsion and $1.0\times10^{-5}$ mol for the smaller-size emulsion, each amount being per mol of silver halide).

Red-sensitive Emulsion Layer

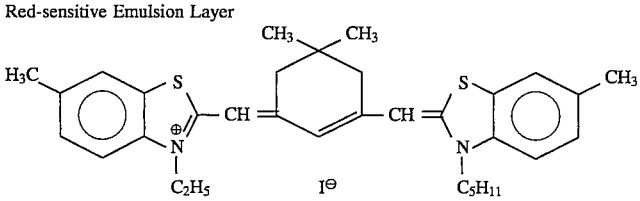

(The dye was used in an amount of $0.9\times10^{-4}$ mol for the larger-size emulsion and $1.1\times10^{-4}$ mol for the smaller-size emulsion, each amount being per mol of silver halide).

The following compound in an amount of $2.6\times10^{-3}$ mol per mol of silver halide was added to red-sensitive emulsion layer.

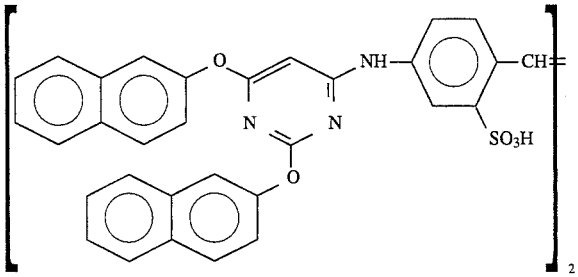

1-(5-Methylureidophenyl)-5-mercaptotetrazole in an amount of $8.5\times10^{-5}$ mol, $7.7\times10^{-4}$ mol, and $2.5\times10^{-4}$ mol per mol of silver halide was added to the blue-sensitive emulsion layer, green-sensitive emulsion layer and red-sensitive emulsion layer, respectively.

4-Hydroxy-6-methyl-1,3,3a,7-tetraazaindene in an amount of $1\times10^{-4}$ mol and $2\times10^{-4}$ mol per mol of silver halide was added to blue-sensitive emulsion layer and green sensitive emulsion layer, respectively.

The following dyes were added to emulsion layers to prevent irradiation.

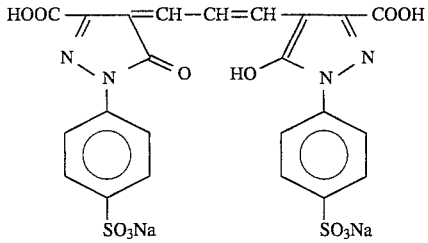

and

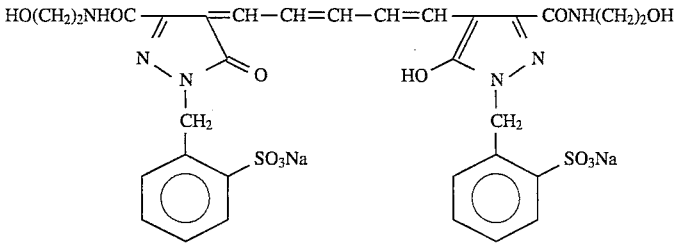

Layer Structure

Each layer had the following composition. Numerals represent coating weight ($g/m^2$). The amounts of silver halide emulsions are represented by coating weight in terms of silver.

| | |
|---|---|
| Support | |
| Polyethylene-laminated paper [Polyethylene on the side of the first layer contains white pigment ($TiO_2$) and bluish dye (ultramarine)] | |
| First Layer: Blue-Sensitive Layer | |
| The above silver chlorobromide emulsion | 0.30 |
| Gelatin | 0.96 |
| Yellow coupler (ExY) | 0.64 |
| Solvent (Solv-1) | 0.26 |
| Second Layer: Color Mixing Inhibiting Layer | |
| Gelatin | 0.99 |
| Color mixing inhibitor (Cpd-4) | 0.08 |

-continued

| | |
|---|---|
| Solvent (Solv-1) | 0.16 |
| Solvent (Solv-4) | 0.08 |
| Third Layer: Green-sensitive Layer | |
| Silver chlorobromide emulsion [a 1:3 (by Ag molar ratio) mixture of emulsion (cube, mean grain size: 0.55 μm) and emulsion (cube, mean grain size: 0.39 μm); a coefficient of variation in grain size distribution being 0.10 and 0.08; each emulsion having 0.8 mol % of AgBr-localized phase on the surface of grain] | 0.12 |
| Gelatin | 1.24 |
| Magenta coupler (M-4) | 0.26 |
| Dye image stabilizer (Cpd-1) | 0.03 |
| Dye image stabilizer (Cpd-2) | 0.15 |
| Dye image stabilizer (Cpd-3) | 0.02 |
| Dye image stabilizer (Cpd-8) | 0.02 |
| Solvent (Solv-2) | 0.40 |
| Fourth Layer: Ultraviolet Light Absorbing Layer | |
| Gelatin | 1.58 |
| Ultraviolet light absorbent (UV-1) | 0.47 |

-continued

| | |
|---|---|
| Color mixing inhibitor (Cpd-4) | 0.05 |
| Solvent (Solv-5) | 0.24 |
| Fifth Layer: Red-sensitive Layer | |
| Silver chlorobromide emulsion [a 1:4 (by Ag molar ratio) mixture of emulsion (cube, mean grain size: 0.58 μm) and emulsion (cube, mean grain size: 0.45 μm); a coefficient of variation in grain size distribution being 0.09 and 0.11; each emulsion having 0.6 mol % of AgBr-localized phase partly on the surface of grain] | 0.23 |
| Gelatin | 1.34 |
| Cyan coupler (ExC) | 0.32 |
| Dye image stabilizer (Cpd-5) | 0.17 |
| Dye image stabilizer (Cpd-6) | 0.40 |
| Dye image stabilizer (Cpd-7) | 0.04 |
| Solvent (Solv-6) | 0.15 |
| Sixth Layer: Ultraviolet Light Absorbing Layer | |

-continued

| | |
|---|---|
| Gelatin | 0.53 |
| Ultraviolet light absorbent (UV-1) | 0.16 |
| Color mixing inhibitor (Cpd-4) | 0.02 |
| Solvent (Solv-5) | 0.08 |
| Seventh Layer: Protective Layer | |
| Gelatin | 1.33 |
| Acrylic-modified copolymer of polyvinyl Alcohol (a degree of modified 17%) | 0.17 |
| Liquid paraffin | 0.03 |

(ExY) Yellow Coupler:

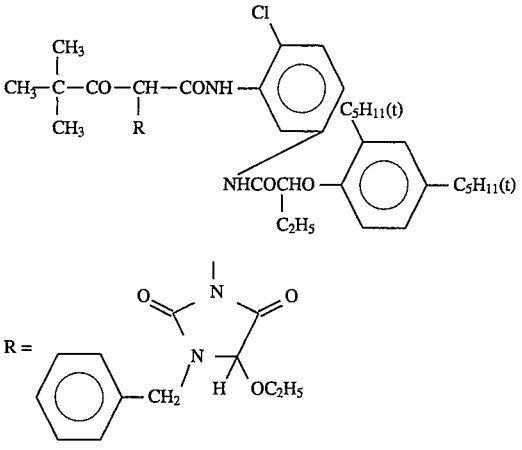

(ExC) Cyan Coupler:

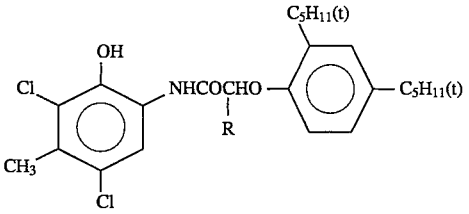

R = $C_2H_5$ and $C_4H_9$ and

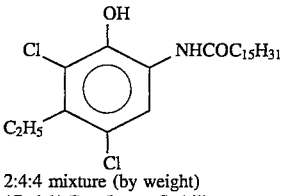

2:4:4 mixture (by weight)

(Cpd-1) Dye Image Stabilizer:

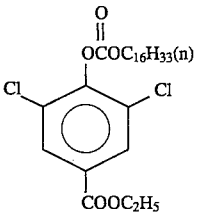

(Cpd-2) Dye Image Stabilizer:

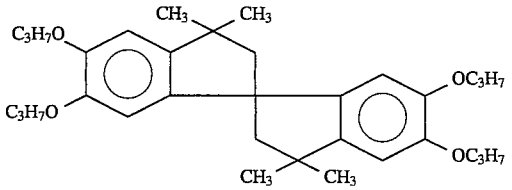

(Cpd-3) Dye Image Stabilizer

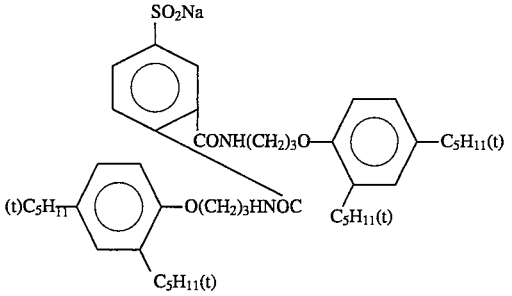

(Cpd-4) Color Mixing Inhibitor

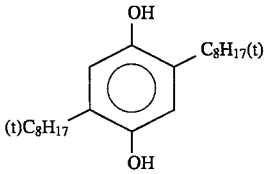

(Cpd-5) Dye Image Stabilizer

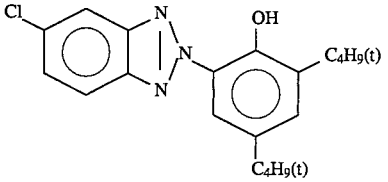

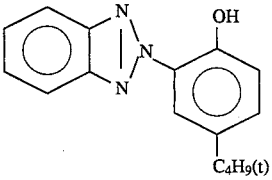

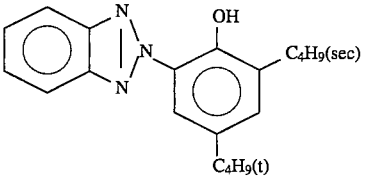

2:2:4 mixture (by weight)

(Cpd-6) Dye Image Stabilizer

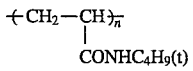

(Average molecular weight 60,000)

(Cpd-7) Dye Image Stabilizer:

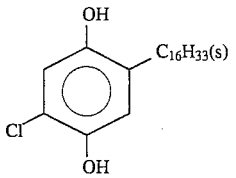

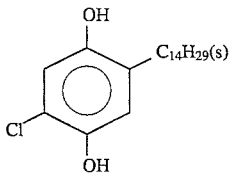

1:1 mixture (by weight)
(Cpd-8) Dye Image Stabilizer:

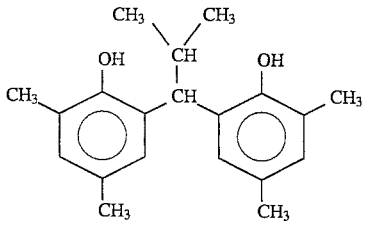

(UV-1) Ultraviolet Light Absorbent

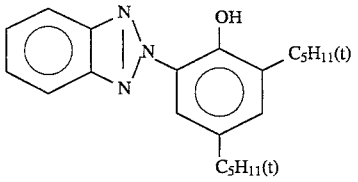

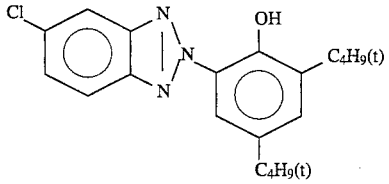

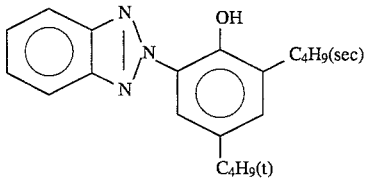

4:2:4 mixture (by weight)
(Solv-1) Solvent:

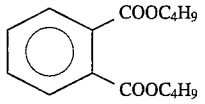

(Solv-2) Solvent:

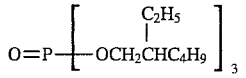

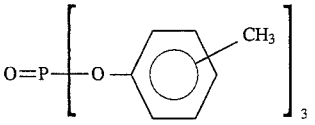

2:1 mixture (by volume)
(Solv-4) Solvent:

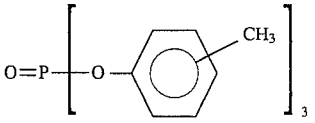

(Solv-5) Solvent

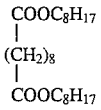

(Solv-6) Solvent

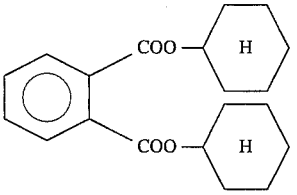

Samples B to G were prepared in the same way as in the preparation of Sample A except that the types of magenta couplers and the coating weights of the components of the first layer were changed to those indicated in Table 1. The coating weight of magenta coupler was 0.31 mmol/m$^2$ in all cases.

Each sample was subjected to gradation exposure with a tricolor separation filter for sensitometry by using a sensitometer (FWH type, color temperature of light source: 3200° K., manufactured by Fuji Photo Film Co., Ltd.). The exposure was conducted such that exposure time was 0.1 second and exposure amount was 250 CMS.

After exposure was completed, the exposed samples were subjected to continuous processing (running test) by using a paper processor until the replenishment rate of color developing solution became twice the tank capacity in the following processing stage.

| Processing Step | Temp. | Time | Replenisher* | Tank Volume |
|---|---|---|---|---|
| Color Development | 35° C. | 45 sec. | 161 ml | 17 l |
| Bleaching-fixing | 30–35° C. | 45 sec. | 215 ml | 17 l |
| Rinse (1) | 30–35° C. | 20 sec. | — | 10 l |
| Rinse (2) | 30–35° C. | 20 sec. | — | 10 l |
| Rinse (3) | 30–35° C. | 20 sec. | 350 ml | 10 l |
| Drying | 70–80° C. | 60 sec. | | |

*Replenishment rate being per m$^2$ of photographic material.
Three tank countercurrent system of rinse (3) to (1) was used.

Each processing solution had the following composition.

| Color Developing Solution | Tank Solution | Replenisher |
|---|---|---|

-continued

| | | |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamido-ethyl)-3-methyl-4-aminoaniline sulfate | 5.0 g | 7.0 g |
| N,N-Bis(carboxymethyl)hydrazine | 5.5 g | 7.0 g |
| Fluorescent brightener (WHITEX 4B, a product of Sumitomo Chemical Co., Ltd.) | 1.0 g | 2.0 g |
| Add water | 1000 ml | 1000 ml |
| pH (25° C.) | 10.05 | 10.45 |

Bleaching-fixing Solution

Tank solution and replenisher being the same.

| | |
|---|---|
| Water | 400 ml |
| Ammonium Thiosulfate (700 g/l) | 100 ml |
| Sodium sulfite | 17 g |
| Ethylenediaminetetraacetic acid iron(III) ammonium | 55 g |
| Disodium ethylenediaminetetraacetate | 5 g |
| Ammonium bromide | 40 g |
| Add water | 1000 ml |
| pH (25° C.) | 6.0 |

Rinsing Solution

Tank solution and replenisher being the same.
Ion exchanged water (the concentration of each of calcium and magnesium being reduced to 3 ppm or below).

The density of the developed yellow color part of each sample was measured through tricolor filters of blue, green and red by using a reflection type densitometer. Each sample was then stored at 80° C. and relative humidity (RH) for 21 days and the density was measured in a similar manner to that described above. Increased amount ($\Delta D^G$) in green filter density at a part of the image which had an initial blue filter density of 2.0 was measured. The results are shown in Table 1.

It is apparent from Table 1 that when the coating weight of yellow coupler is at least 1.1 mmol/m$^2$ and oil/coupler ratio by weight is 0.32 or less as in the photographic materials of the present invention, there can be obtained photographic materials which cause less of an increase in magenta density (G density) in the developed yellow color part after storage under moist heat conditions and which cause less of a change in the hue of yellow dye image during storage.

According to the present invention, high-quality color image can be obtained even when rapid processing is conducted. The resulting color image causes less of an increase in magenta density in yellow image part even when stored under high temperature and humidity conditions and is very excellent in yellow color reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support a yellow coupler-containing silver halide emulsion layer, a magenta coupler-containing silver halide emulsion layer and a cyan coupler-containing silver halide emulsion layer, wherein each silver halide emulsion layer contains silver halide grains having a silver chloride content of not lower than 90 mol %; a yellow coupler in the yellow coupler-containing silver halide emulsion layer is coated in an amount of at least 1.1 mmol/m$^2$, the yellow coupler being represented by the following general formula Y:

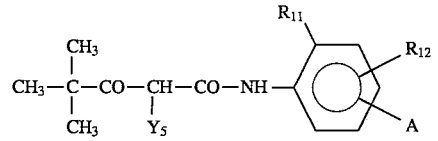

(Y)

wherein $R_{11}$ is an alkoxy group, $R_{12}$ is a hydrogen atom, a halogen atom or an alkoxy group; A is $NHCOR_{13}$, $NHSO_2$—$R_{13}$, $SO_2NHR_{13}$, $COOR_{13}$, or

TABLE 1

| Sample | Magenta Coupler Species | Coating Weight of Components in First Layer: Yellow Coupler (a) mmol/m$^2$ (g/m$^2$) | Oil (b) g/m$^2$ | Gelatin (c) g/m$^2$ | Oil/Coupler Ratio b/a (by wt.) | Gelatin/Oil-soluble Component Ratio c/(a + b) (by wt.) | $\Delta D^G$ (*) |
|---|---|---|---|---|---|---|---|
| A (Comparison) | M-4 | 0.80 (0.64) | 0.26 | 0.96 | 0.40 | 1.07 | 0.55 |
| B (Comparison) | " | 0.95 (0.76) | 0.26 | 0.96 | 0.34 | 0.94 | 0.53 |
| C (Comparison) | " | 0.95 (0.76) | 0.24 | 1.00 | 0.31 | 1.00 | 0.53 |
| D (Comparison) | " | 0.95 (0.76) | 0.26 | 1.15 | 0.34 | 1.13 | 0.50 |
| E (Invention) | " | 1.10 (0.88) | 0.27 | 1.15 | 0.31 | 1.00 | 0.35 |
| F (Invention) | " | 1.40 (1.12) | 0.26 | 1.44 | 0.23 | 1.04 | 0.32 |
| G (Comparison) | " | 1.40 (1.12) | 0.38 | 1.44 | 0.34 | 0.90 | 0.50 |
| H (Invention) | " | 1.40 (1.12) | 0.26 | 1.24 | 0.23 | 0.90 | 0.37 |
| I (Invention) | " | 1.70 (1.37) | 0.33 | 1.79 | 0.24 | 1.05 | 0.30 |
| J (Comparison) | M-12 | 0.80 (0.64) | 0.26 | 0.96 | 0.40 | 1.07 | 0.56 |
| K (Comparison) | " | 0.95 (0.76) | 0.26 | 0.96 | 0.34 | 0.94 | 0.55 |
| L (Comparison) | " | 0.95 (0.76) | 0.24 | 1.00 | 0.31 | 1.00 | 0.55 |
| M (Comparison) | " | 0.95 (0.76) | 0.26 | 1.14 | 0.34 | 1.12 | 0.51 |
| N (Invention) | " | 1.10 (0.88) | 0.27 | 1.16 | 0.31 | 1.01 | 0.34 |
| O (Invention) | " | 1.40 (1.12) | 0.26 | 1.44 | 0.23 | 1.04 | 0.32 |
| P (Invention) | " | 1.70 (1.37) | 0.26 | 1.78 | 0.19 | 1.09 | 0.29 |
| Q (Invention) | M-16 | 1.70 (1.37) | 0.33 | 1.79 | 0.24 | 1.05 | 0.33 |

(*) Increased amount in green filter density at a part of the image which had an initial blue filter density of 2.0 after storage at 80° C. 70% RH for 21 days.

$SO_2N(R_{14})-R_{13}$;

$R_{13}$ and $R_{14}$ are each an alkyl group, an aryl group or an acyl group; $R_{12}$, $R_{13}$ and $R_{14}$ may be substituted, and $Y_5$ is an elimination group; an oil can be present and when an oil is present in the yellow coupler-containing silver halide emulsion layer, the yellow coupler-containing silver halide emulsion layer has an oil/coupler ratio by weight of 0.32 or less; and the magenta coupler-containing silver halide emulsion layer contains at least one magenta coupler represented by the following general formula (I):

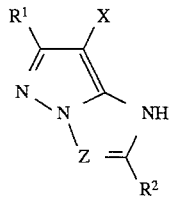

(I)

wherein $R^1$ and $R^2$ each represents a hydrogen atom or a substituent group; X represents a hydrogen atom or a group which is eliminated by a coupling reaction with an oxidation product of an aromatic primary amine developing agent; Z represents a nitrogen atom or a carbon atom and when Z represents carbon atom, a substituent group may be bonded to the carbon atom; and a dimer or higher polymer may be formed through $R^1$, $R^2$ or X, or when Z is carbon atom, a dimer or a higher polymer may be formed through said carbon atom.

2. A silver halide color photographic material as in claim 1, wherein gelatin is present in the yellow coupler-containing silver halide emulsion layer, and the ratio by weight of the amount of gelatin in the yellow coupler-containing silver halide emulsion layer to that of an oil-soluble component in said emulsion layer is not lower than 1.0.

3. A silver halide color photographic material as in claim 1, wherein the magenta coupler-containing silver halide emulsion layer contains at least one magenta coupler represented by either of the following general formulae (II) and (III):

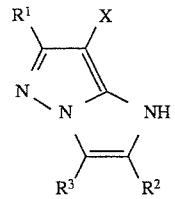

(II)

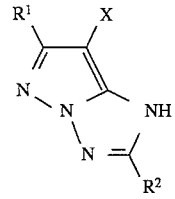

(III)

wherein $R^1$, $R^2$ and $R^3$ are independently a hydrogen atom, a halogen atom, an alkyl group, an aryl group, a heterocyclic group, cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X is a hydrogen atom, a halogen atom, a carboxyl group or a group that is bonded to a carbon atom at the coupling position through an oxygen atom, a nitrogen atom or a sulfur atom and is eliminated by a coupling reaction.

4. A silver halide color photographic material as in claim 3, wherein $R^1$, $R^2$, $R^3$ or X is a bivalent group that forms a bis-compound.

5. A silver halide color photographic material as in claim 1, wherein the magenta coupler is present in an amount of 0.1 to 1.0 mol per mol of silver halide in the magenta coupler-containing silver halide emulsion layer.

6. A silver halide color photographic material as in claim 5, wherein the magenta coupler is present in an amount of 0.1 to 0.5 mol per mol of silver halide in the magenta coupler-containing silver halide emulsion layer.

7. A silver halide color photographic material as in claim 1, wherein the silver halide emulsions contain not higher than 1 mol % of silver iodide.

8. A silver halide color photographic material as in claim 7, wherein the silver halide emulsions contain not higher than 0.2 mol % of silver iodide.

9. A silver halide color photographic material as in claim 1, wherein the silver halide emulsions have a silver chloride content of not less than 95 mol %.

10. A silver halide color photographic material as in claim 1, wherein the cyan coupler is represented by the following general formulae (C-I) and (C-II):

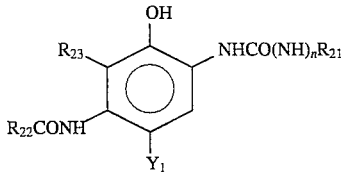

(C-I)

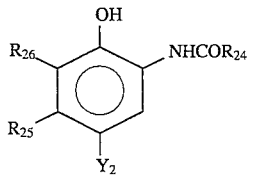

(C-II)

wherein $R_{21}$, $R_{22}$ and $R_{24}$ are each a substituted or unsubstituted aliphatic, aromatic or heterocyclic group; $R_{23}$, $R_{25}$ and $R_{26}$ are each a hydrogen atom, a halogen atom, an aliphatic group, an aromatic group or an acylamino group; $R_{23}$ and $R_{22}$ may be a non-metallic atomic group for forming a nitrogen-containing 5-membered or 6-membered ring; $Y_1$ and $Y_2$ are each a hydrogen atom or a group that is eliminated by coupling reaction with an oxidation product of a developing agent; and n is 0 or 1.

11. A silver halide color photographic material as in claim 10, wherein the cyan coupler is present in an amount of 0.1 to 1.0 mol per mol of silver halide in the cyan coupler-containing silver halide emulsion layer.

12. A silver halide color photographic material as in claim 11, wherein the cyan coupler is present in an amount of 0.1 to 0.5 mol per mol of silver halide in the cyan coupler-containing silver halide emulsion layer.

13. A silver halide color photographic material as in claim 1, wherein an ultraviolet light absorbing agent is present in the cyan color forming layer.

* * * * *